US010737486B2

(12) United States Patent
Sakurada

(10) Patent No.: US 10,737,486 B2
(45) Date of Patent: Aug. 11, 2020

(54) PRINTING METHOD AND PRINTING APPARATUS

(71) Applicant: SEIKO EPSON CORPORATION, Tokyo (JP)

(72) Inventor: Kazuaki Sakurada, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 25 days.

(21) Appl. No.: 15/832,564

(22) Filed: Dec. 5, 2017

(65) Prior Publication Data

US 2018/0154629 A1 Jun. 7, 2018

(30) Foreign Application Priority Data

Dec. 7, 2016 (JP) ..... 2016-237335

(51) Int. Cl.
*B41J 2/045* (2006.01)
*B41J 2/21* (2006.01)
*B41J 19/14* (2006.01)

(52) U.S. Cl.
CPC ..... *B41J 2/04505* (2013.01); *B41J 2/04581* (2013.01); *B41J 2/2135* (2013.01); *B41J 19/145* (2013.01)

(58) Field of Classification Search
CPC ..... B41J 2/2135; B41J 2/04505; B41J 19/145
See application file for complete search history.

(56) References Cited

U.S. PATENT DOCUMENTS 8,308,274 B2 * 11/2012 Sheahan ..... B41J 2/0458 347/43
9,604,450 B2 3/2017 Reder
2002/0008731 A1 * 1/2002 Matsumoto ..... B41J 2/155 347/42
2003/0122890 A1 * 7/2003 Shimada ..... B41J 2/2132 347/19
2004/0207675 A1 * 10/2004 Otsuki ..... B41J 2/2135 347/19
2008/0225074 A1 9/2008 Van De Wynckel et al.
2009/0244153 A1 10/2009 Miyamoto
(Continued)

FOREIGN PATENT DOCUMENTS

CN 106170393 11/2016
DE 102014203420 A1 8/2015
JP 2009-234116 10/2009

OTHER PUBLICATIONS

European Search Report issued in EP 17205728 dated Apr. 10, 2018.

*Primary Examiner* — John Zimmermann
(74) *Attorney, Agent, or Firm* — Workman Nydegger

(57) ABSTRACT

A printing method includes a printing process that performs printing on a recording medium, in which, in the printing process, a first correction is performed in which discharging portions, where a first correction target head other than a first reference head among heads of a first group and a second correction target head other than the first reference head among the heads of a second group discharge inks, are corrected based on a first reference printing pattern, and a second correction is performed in which a discharging portion, where a third correction target head among heads of a third group other than a second reference head discharges the inks, is corrected based on the first reference printing pattern and a second reference printing pattern.

10 Claims, 15 Drawing Sheets

(56) References Cited

U.S. PATENT DOCUMENTS

| | | | | |
|---|---|---|---|---|
| 2012/0223994 | A1 | 9/2012 | Yuda et al. | |
| 2014/0292863 | A1* | 10/2014 | Tanase | B41J 2/12 347/13 |
| 2015/0306870 | A1* | 10/2015 | Sumiyoshi | B41J 2/2146 347/9 |

* cited by examiner

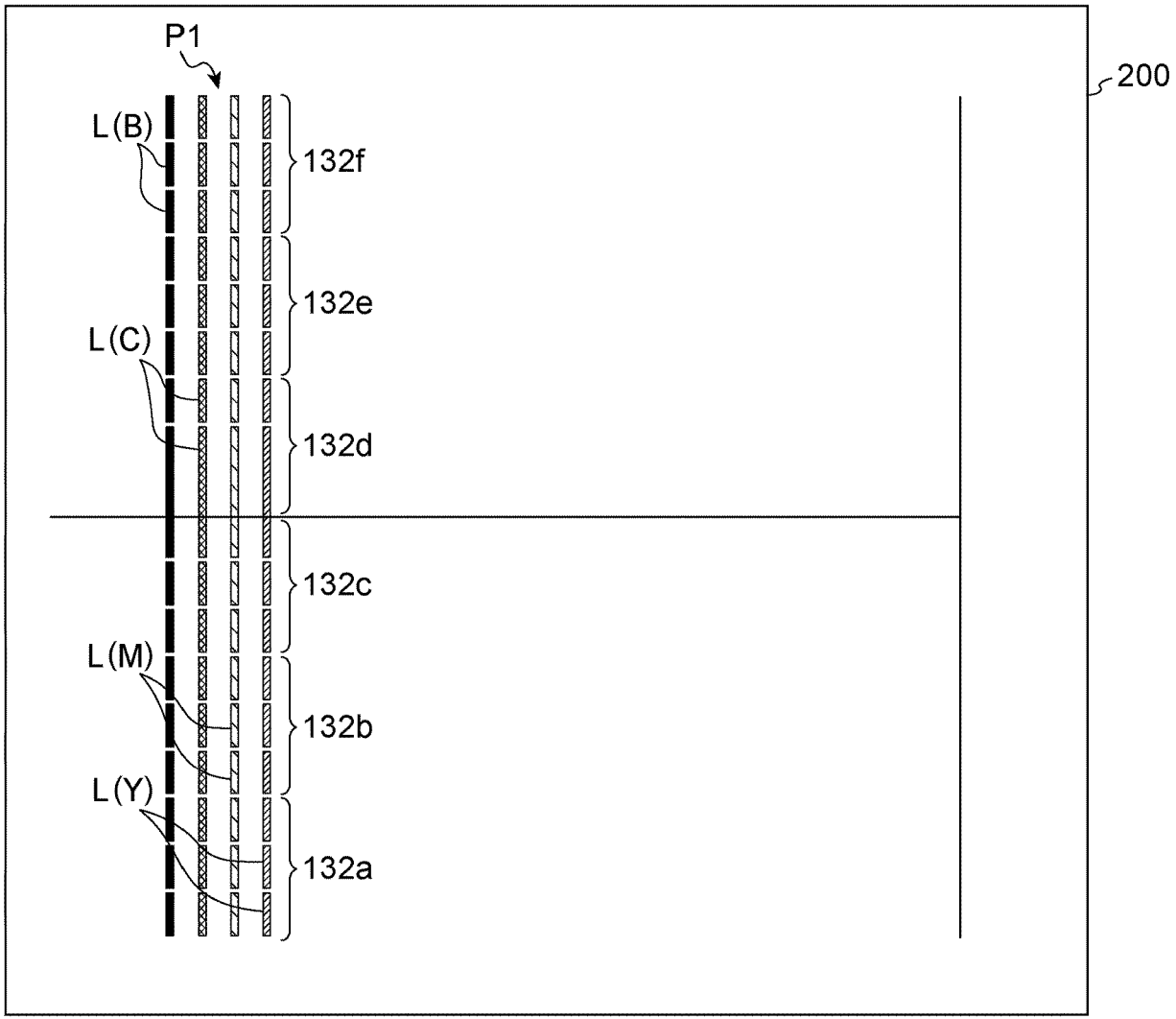
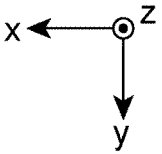
FIG. 10

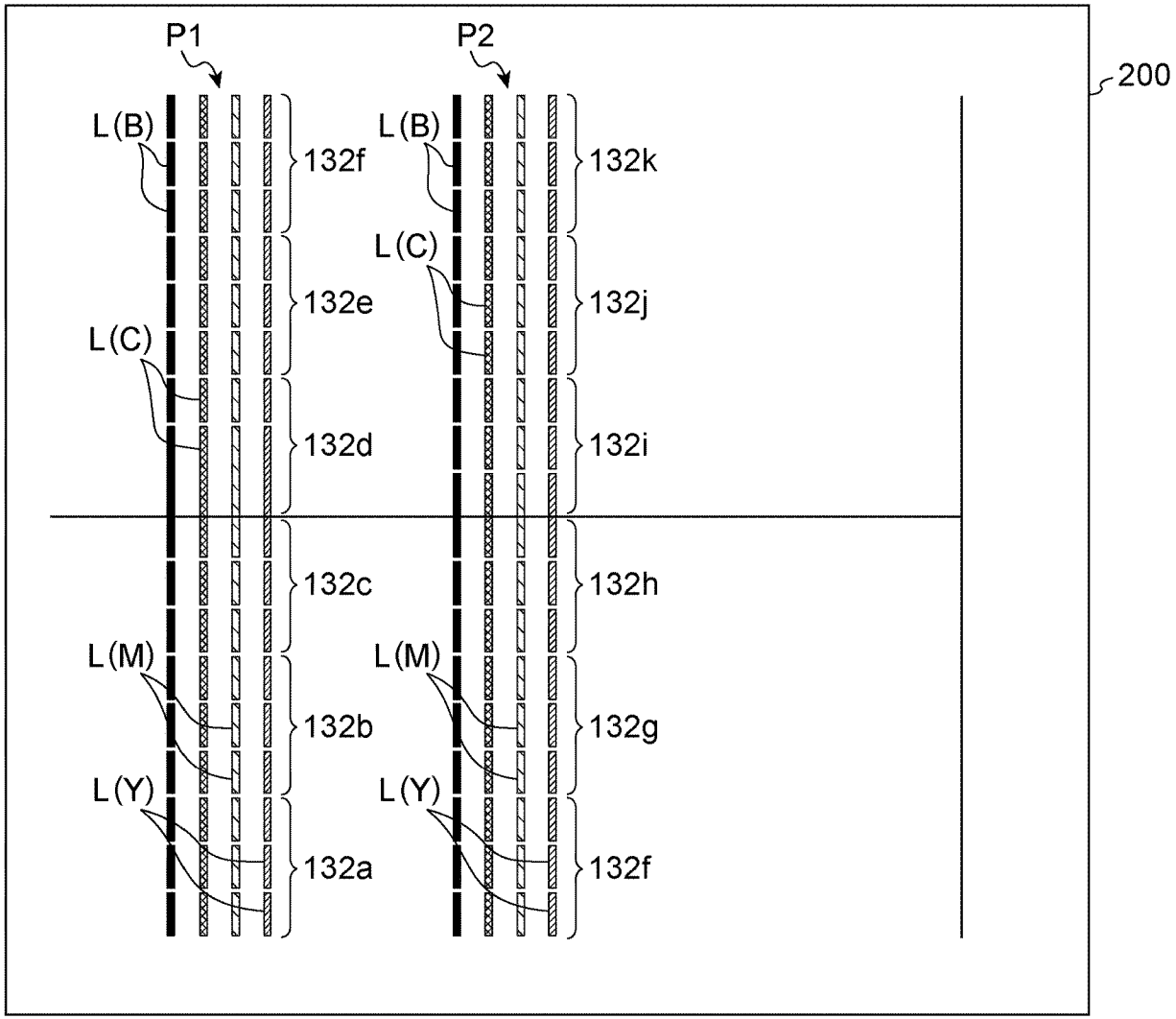
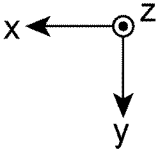
FIG. 11

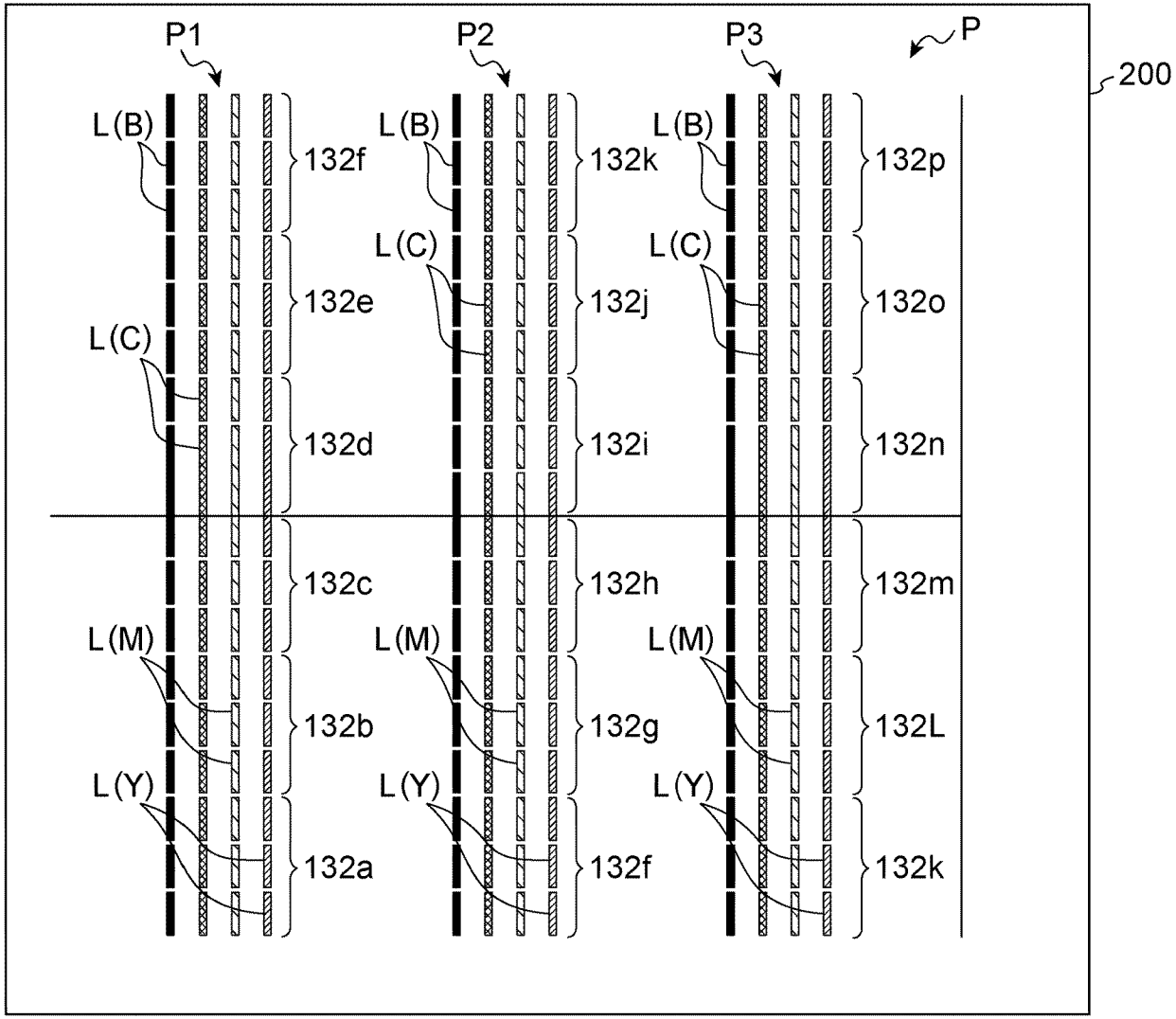
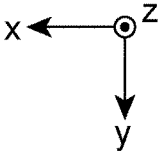
FIG. 12

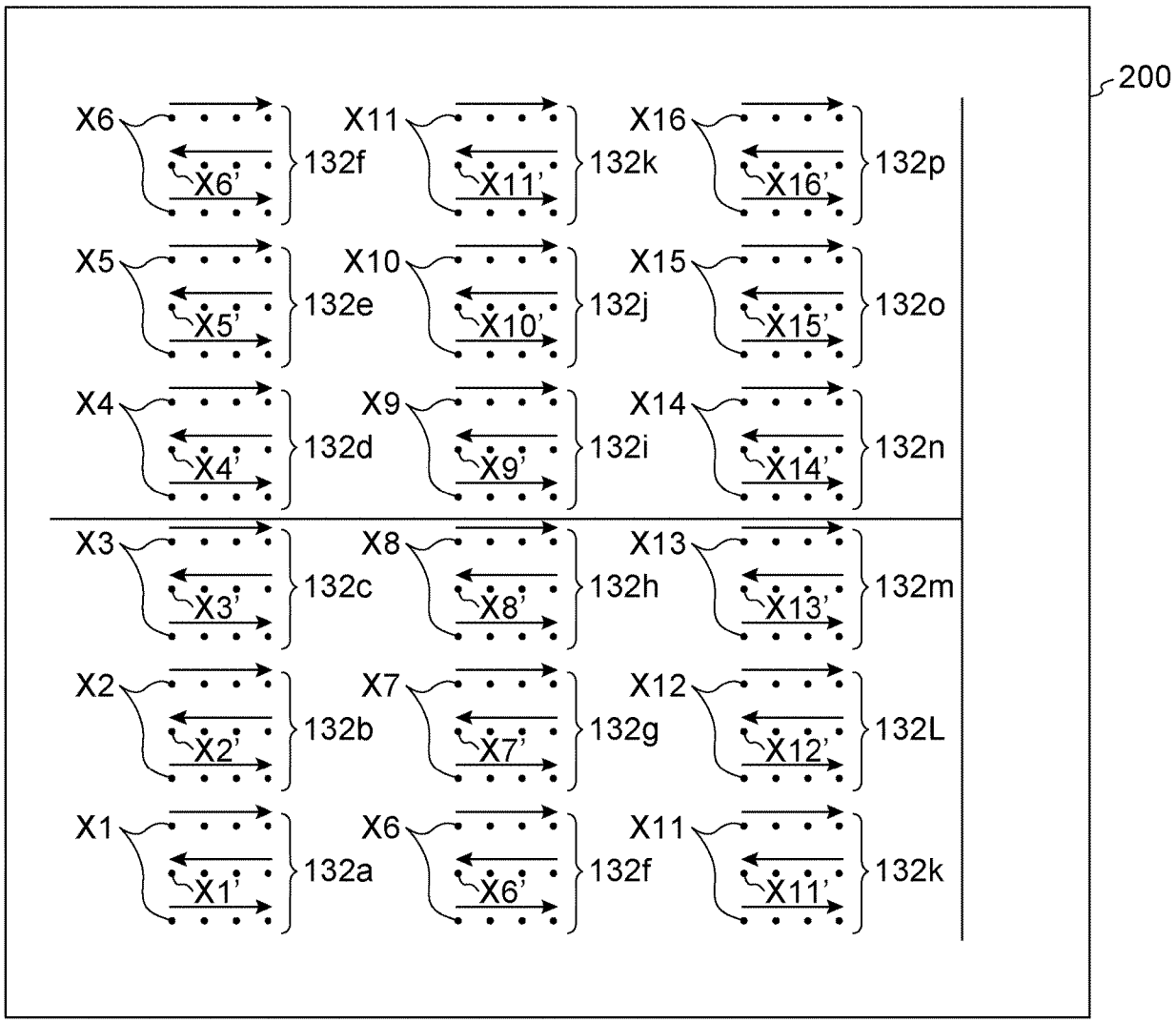
FIG. 14
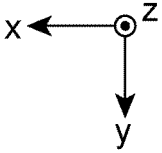

FIG. 15

| GROUP NUMBER | HEAD NUMBER | X COORDINATE | | AMOUNT OF CORRECTION | |
|---|---|---|---|---|---|
| | | GOING PASSAGE | RETURNING PASSAGE | GOING PASSAGE | RETURNING PASSAGE |
| G1 | 132a | X1 | X1' | X1−X6 | X1'−X6 |
| | 132b | X2 | X2' | X2−X6 | X2'−X6 |
| | 132c | X3 | X3' | X3−X6 | X3'−X6 |
| | 132d | X4 | X4' | X4−X6 | X4'−X6 |
| | 132e | X5 | X5' | X5−X6 | X5'−X6 |
| | 132f | X6 | X6' | X5−X6 | X5'−X6 |
| G2 | 132f | X6 | X6' | X6−X6 | X6'−X6 |
| | 132g | X7 | X7' | X7−X6 | X7'−X6 |
| | 132h | X8 | X8' | X8−X6 | X8'−X6 |
| | 132i | X9 | X9' | X9−X6 | X9'−X6 |
| | 132j | X10 | X10' | X10−X6 | X10'−X6 |
| | 132k | X11 | X11' | X11−X6 | X11'−X6 |
| G3 | 132k | X11 | X11' | (X11−X11)+(X11−X6)=X11−X6 | (X11'−X11)+(X11−X6) |
| | 132L | X12 | X12' | (X12−X11)+(X11−X6) | (X12'−X11)+(X11−X6) |
| | 132m | X13 | X13' | (X13−X11)+(X11−X6) | (X13'−X11)+(X11−X6) |
| | 132n | X14 | X14' | (X14−X11)+(X11−X6) | (X14'−X11)+(X11−X6) |
| | 132o | X15 | X15' | (X15−X11)+(X11−X6) | (X15'−X11)+(X11−X6) |
| | 132p | X16 | X16' | (X16−X11)+(X11−X6) | (X16'−X11)+(X11−X6) |

PRINTING METHOD AND PRINTING APPARATUS

BACKGROUND

1. Technical Field

The present invention relates to a printing method and a printing apparatus.

2. Related Art

A printing apparatus which performs printing by applying inks onto a recording medium is used from the related art (for example, refer to JP-A-2009-234116). A printing apparatus disclosed in JP-A-2009-234116 is provided with a transporting unit that transports a recording medium, and a printing portion that includes a plurality of nozzles which discharge inks onto the recording medium being transported while reciprocating along a direction intersecting a transporting direction of the recording medium.

In such a printing apparatus, a test printing is performed on a test medium before printing is performed on the recording medium, and a discharging position of each nozzle is corrected based on a result of the test printing.

However, it is difficult to accurately correct a discharging position in each nozzle in a printing apparatus which includes a relatively large printing portion.

SUMMARY

An advantage of some aspects of the invention is to provide a printing method and a printing apparatus which are capable of accurately correcting a discharging position of each head.

According to an aspect of the invention, there is provided a printing method including performing printing on a recording medium, in which, in the printing, a printing apparatus is used, which includes a head unit in which a plurality of heads discharging inks are disposed side by side, and discharges the inks while relatively moving the head unit and the recording medium, and when the head unit is logically divided into at least three groups of a first group, a second group, and a third group in a direction where the plurality of heads are positioned side by side, the first group and the second group share one head, the head being shared is set as a first reference head, the second group and the third group share one head, and the head being shared is set as a second reference head, in the printing, a first correction is performed in which a discharging position, where a first correction target head other than the first reference head among the heads of the first group discharges the inks, is corrected based on a position where the first reference head discharges the inks, and a discharging position, where a second correction target head other than the first reference head among the heads of the second group discharges the inks, is corrected based on the position where the first reference head discharges the inks, and a second correction is performed in which a discharging position, where a third correction target head other than the second reference head among the heads of the third group discharges the inks, is corrected based on the discharging position where the first reference head discharges the inks and the discharging position where the second reference head discharges the inks.

Accordingly, the discharging positions of the heads of the first group and the second group are corrected based on a first reference printing pattern, the discharging positions of the heads of the third group are corrected based on the first reference printing pattern and a second reference printing pattern, and thus the discharging positions of the heads of the third group can be accurately corrected. As a result, printing can be clearly performed. Particularly, in a case in which the head unit is relatively large, the first reference head of the first group and the heads of the third group are relatively separated, and the discharging positions of the heads of the third group are difficult to be accurately corrected, but the invention is particularly effective in such a case.

In the printing method of the invention, it is preferable that the first correction be correction in which a discharging position be changed by an amount of deviation between a first reference printing pattern being printed by the first reference head and a first correction target pattern printed by the first correction target head, and a discharging position be changed by an amount of deviation between the first reference printing pattern and a second correction target pattern printed by the second correction target head.

Accordingly, the correction of the discharging positions of the heads of the first group and the second group can be accurately performed.

In the printing method of the invention, it is preferable that the second correction be correction in which a discharging position be changed by an amount obtained by adding an amount of deviation between a second reference printing pattern being printed by the second reference head and a third correction target pattern being printed by the third correction target head to an amount of deviation between the first reference printing pattern printed by the first reference head and the second reference printing pattern.

Accordingly, the correction of the discharging positions of the heads of the third group can be accurately performed.

In the printing method of the invention, it is preferable that the head include a plurality of nozzles aligned in one direction, and the first reference printing pattern, the second reference printing pattern, the first correction target pattern, the second correction target pattern, and the third correction target pattern each have a linear shape along the one direction.

Accordingly, the centers of the first reference printing pattern, the second reference printing pattern, the first correction target pattern, the second correction target pattern, and the third correction target pattern can be easily detected.

In the printing method of the invention, it is preferable that the printing apparatus perform the printing while the head unit reciprocate with respect to the recording medium, and in the printing, the first correction and the second correction be performed in both of a going passage and a returning passage.

Accordingly, the discharging position in the going passage and the returning passage can be matched.

In the printing method of the invention, it is preferable that the printing apparatus include a plurality of the head units discharging the inks having different colors from each other, and in the printing, the first correction and the second correction be performed for each head unit.

Accordingly, the correction of the discharging positions of the heads of all colors can be performed.

In the printing method of the invention, it is preferable that the printing be a test printing being performed before printing be performed on the recording medium.

Accordingly, the printing process performing printing on the recording medium can be performed with high accuracy.

According to another aspect of the invention, there is provided a printing apparatus including a head unit in which a plurality of heads discharging inks are disposed side by side, and discharging the inks while moving the head unit, the apparatus including, a controller that performs, when the head unit is logically divided into at least three groups of a first group, a second group, and a third group in a direction where the plurality of heads are positioned side by side, the first group and the second group share one head, the head being shared is set as a first reference head, the second group and the third group share one head, and the head being shared is set as a second reference head, a first correction in which a discharging position, where a first correction target head other than the first reference head among the heads of the first group discharges the inks, is corrected based on a position where the first reference head discharges the inks, and a discharging position, where a second correction target head other than the first reference head among the heads of the second group discharges the inks, is corrected based on the position where the first reference head discharges the inks, and a second correction in which a discharging position, where a third correction target head other than the second reference head among the heads of the third group discharges the inks, is corrected based on the discharging position where the first reference head discharges the inks and the discharging position where the second reference head discharges the inks.

Accordingly, the correction of the discharging positions of the heads of the first group and the second group are performed based on the first reference printing pattern, the correction of the discharging positions of the heads of the third group are performed based on the first reference printing pattern and the second reference printing pattern, and thus the correction of the discharging positions of the heads of the third group can be accurately performed. As a result, the printing can be clearly performed. Particularly, in a case in which the head unit is relatively large, the first reference head of the first group and the heads of the third group are relatively separated from each other, and the discharging positions of the heads of the third group are difficult to be accurately corrected, but the invention is particularly effective in such a case.

According to still another aspect of the invention, there is provided a printing pattern being printed by a printing apparatus including a head unit in which a plurality of heads discharging inks are disposed side by side, and discharging the inks toward a recording medium while transporting the recording medium in a direction intersecting a direction where the heads are positioned side by side, in which, when the head unit is logically divided into at least two groups of a first group and a second group which share at least one head in a direction where the plurality of heads are positioned side by side, a first test printing pattern being printed by the first group and a second test printing pattern being printed by the second group are disposed side by side along a direction intersecting a transporting direction of the recording medium.

Accordingly, the correction of the discharging position of each head can be easily and accurately performed by performing the test printing using such a printing pattern. As a result, this printing can be clearly performed.

In the printing pattern of the invention, it is preferable that, when the head unit be logically divided into at least three groups of a first group, a second group, and a third group which share at least one head in a direction where the plurality of heads are positioned side by side, the first test printing pattern, the second test printing pattern, and a third test printing pattern being printed by the third group be disposed side by side along a direction intersecting the transporting direction of the recording medium.

Accordingly, the correction of the discharging position of each head can be easily and accurately performed by performing the test printing using such a printing pattern. As a result, this printing can be clearly performed.

BRIEF DESCRIPTION OF THE DRAWINGS

The invention will be described with reference to the accompanying drawings, wherein like numbers reference like elements.

FIG. 10 is a view illustrating a state in which the test printing pattern is formed on the test medium.

FIG. 11 is a view illustrating the state in which the test printing pattern is formed on the test medium.

FIG. 12 is a view illustrating the state in which the test printing pattern is formed on the test medium.

FIG. 14 is a view illustrating central coordinates of the ruled line in a plan view of the test medium.

FIG. 15 is a table illustrating an amount of correction of a discharging position of a head in a first correction and a second correction.

DESCRIPTION OF EXEMPLARY EMBODIMENTS

Hereinafter, a printing method and a printing apparatus of the invention will be described in detail based on appropriate embodiments illustrated in attached drawings.

First Embodiment

Figure 1:
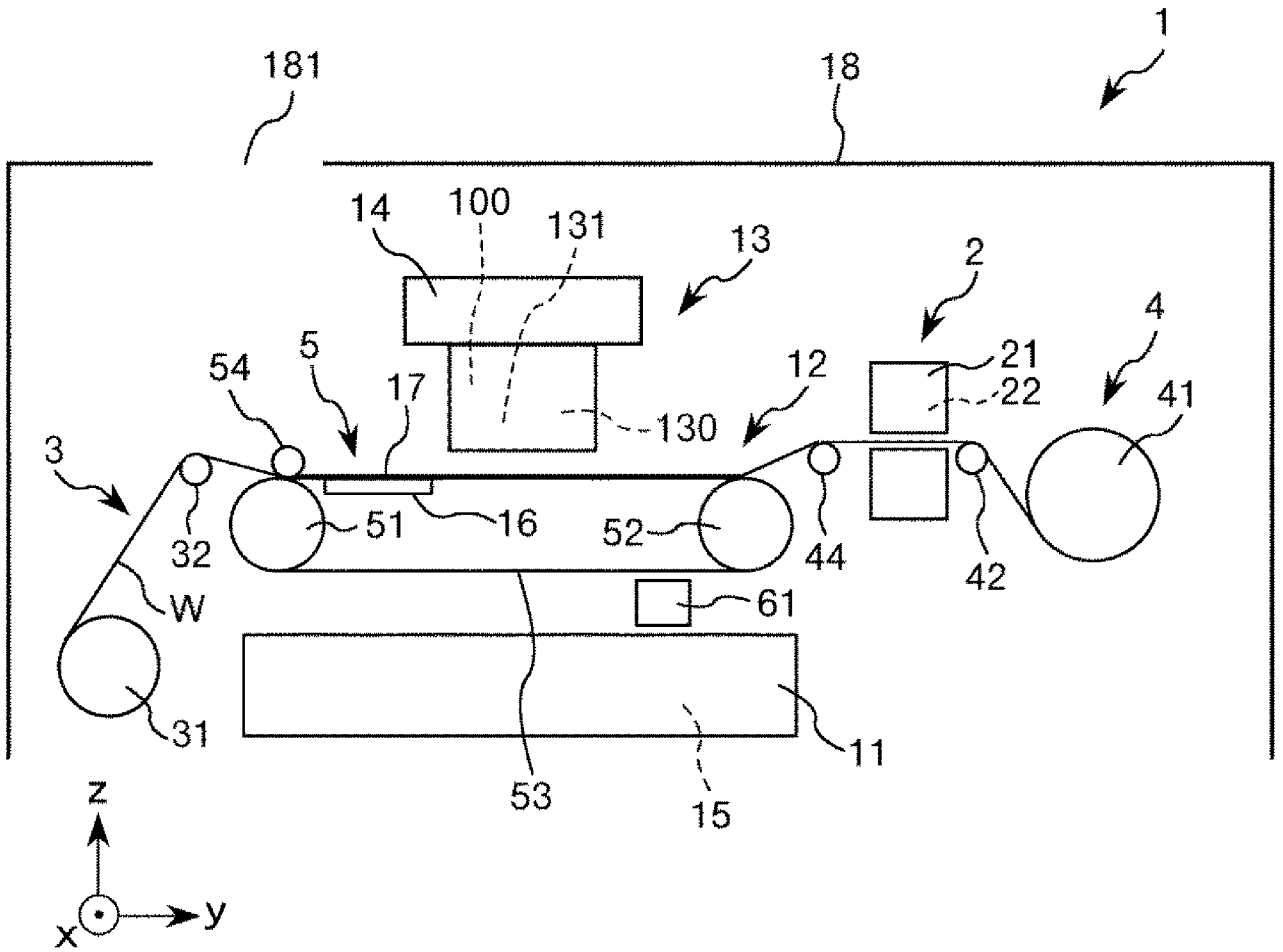
FIG. 1 is a schematic side view illustrating a first embodiment of a printing apparatus of the invention.
Figure 2:
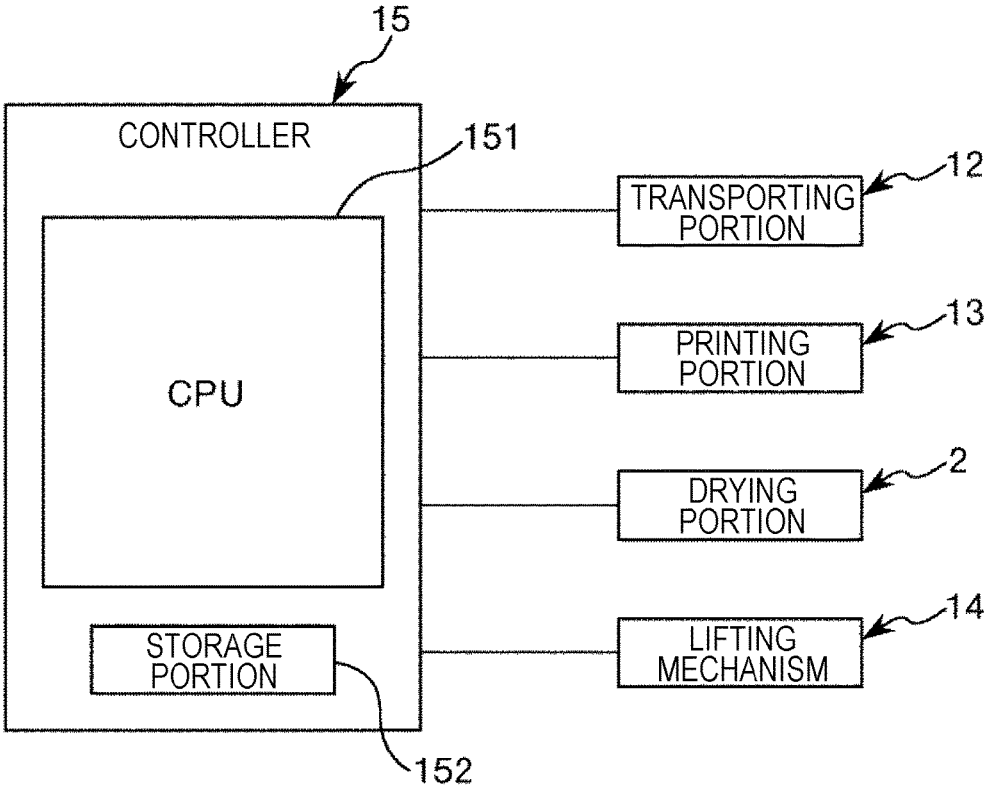
FIG. 2 is a block diagram of a main portion of the printing apparatus illustrated in FIG. 1.
Figure 3:
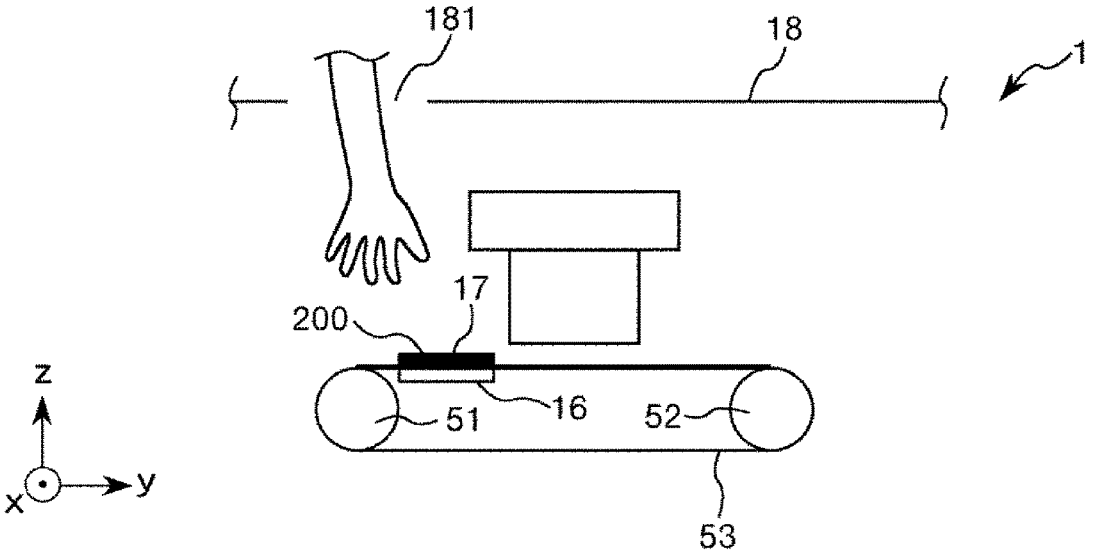
FIG. 3 is a schematic configuration view illustrating a state in which the printing apparatus illustrated in FIG. 1 performs a test printing, and is a view illustrating a state in which a test medium is mounted on a mounting portion.
Figure 4:
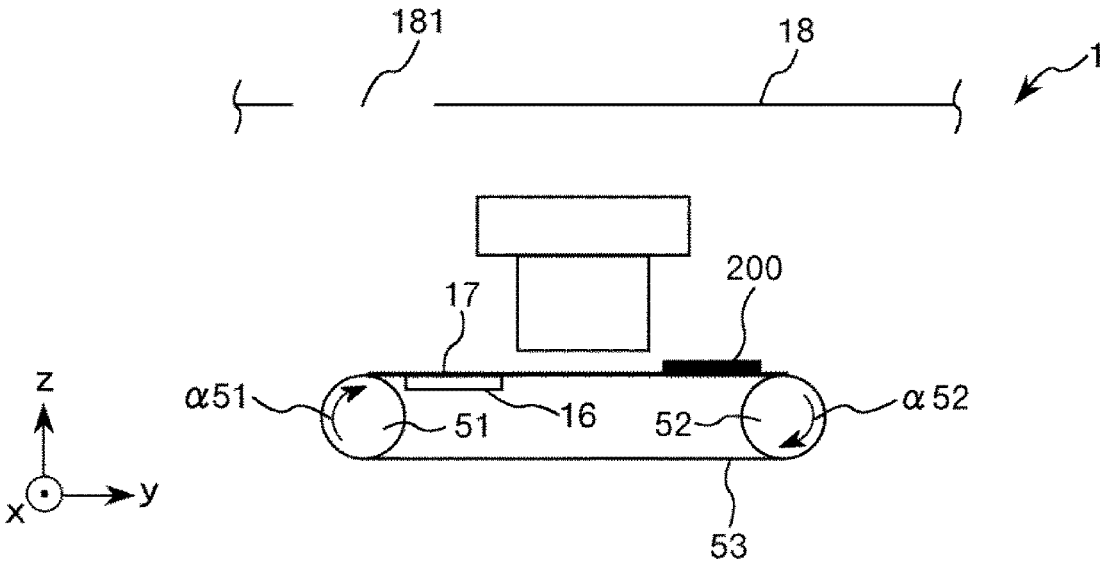
FIG. 4 is a schematic configuration view illustrating the state in which the printing apparatus illustrated in FIG. 1 performs the test printing, and is a view illustrating a state in which the test printing is completed.
Figure 5:
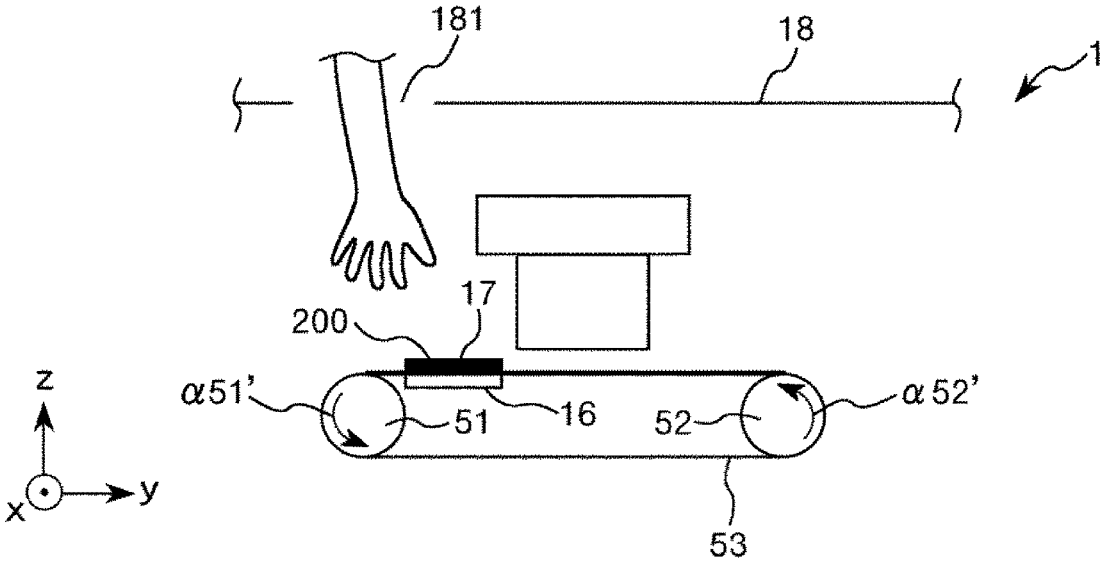
FIG. 5 is a schematic configuration view illustrating the state in which the printing apparatus illustrated in FIG. 1 performs the test printing, and is a view illustrating a state in which the test medium is taken out from the mounting portion.
Figure 6:
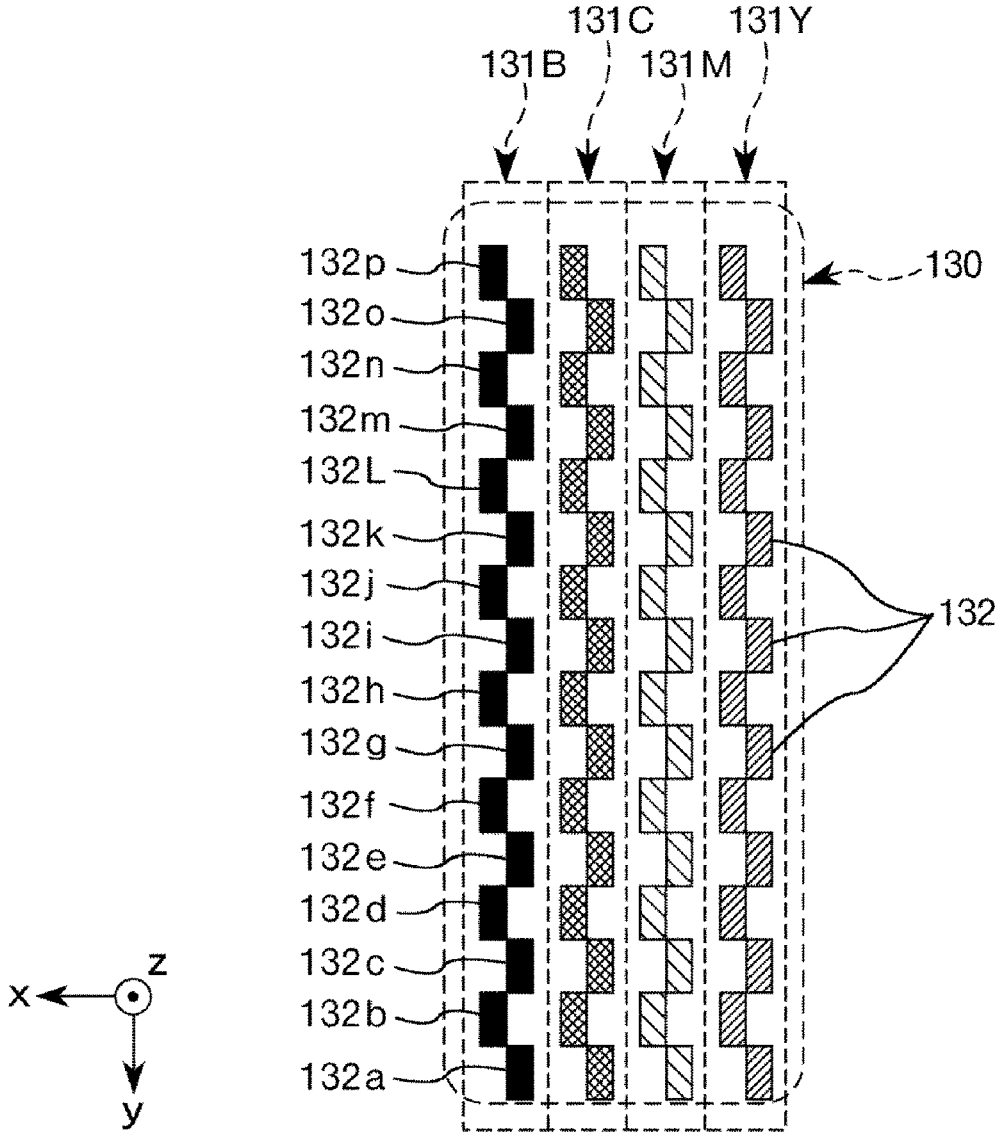
FIG. 6 is a view illustrating a carriage unit provided in the printing apparatus illustrated in FIG. 1.
Figure 7:
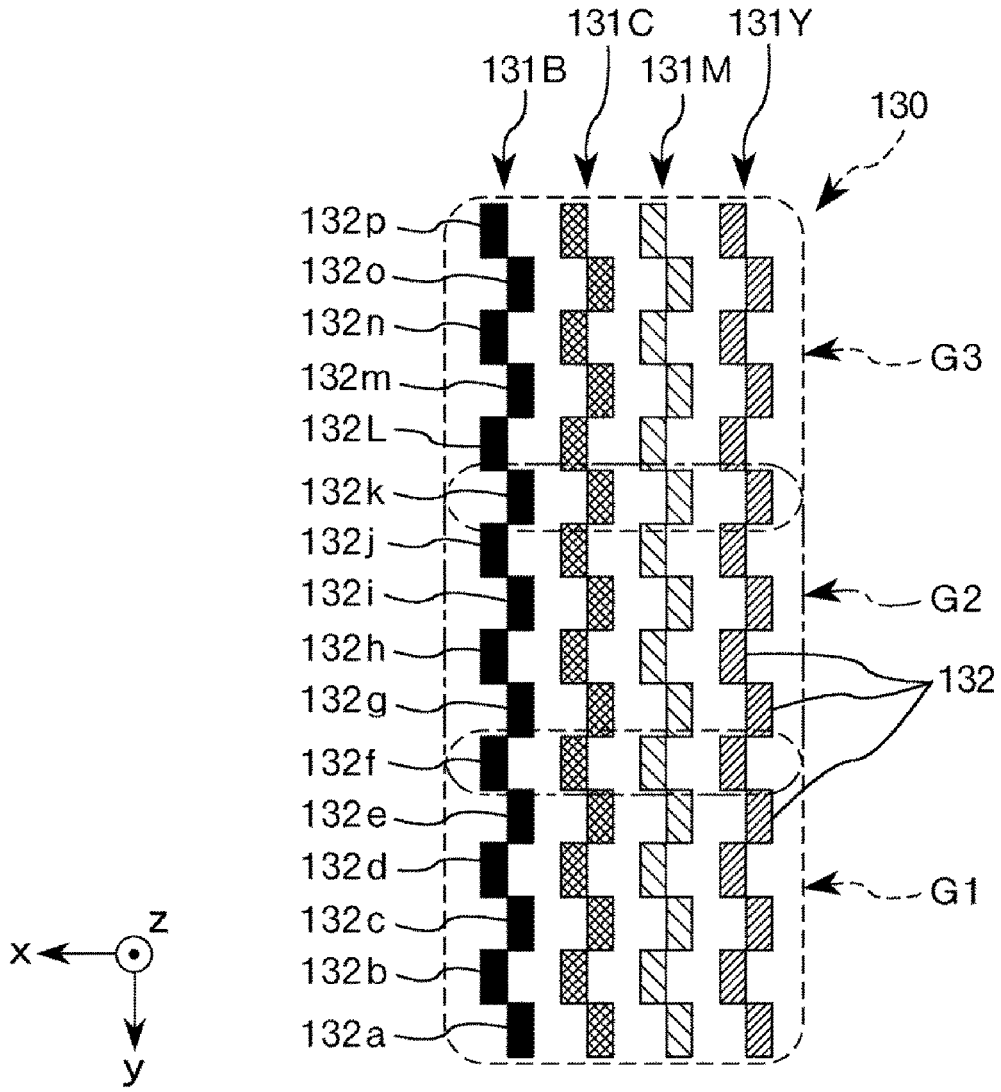
FIG. 7 is a view illustrating the carriage unit provided in the printing apparatus illustrated in FIG. 1.
Figure 8:
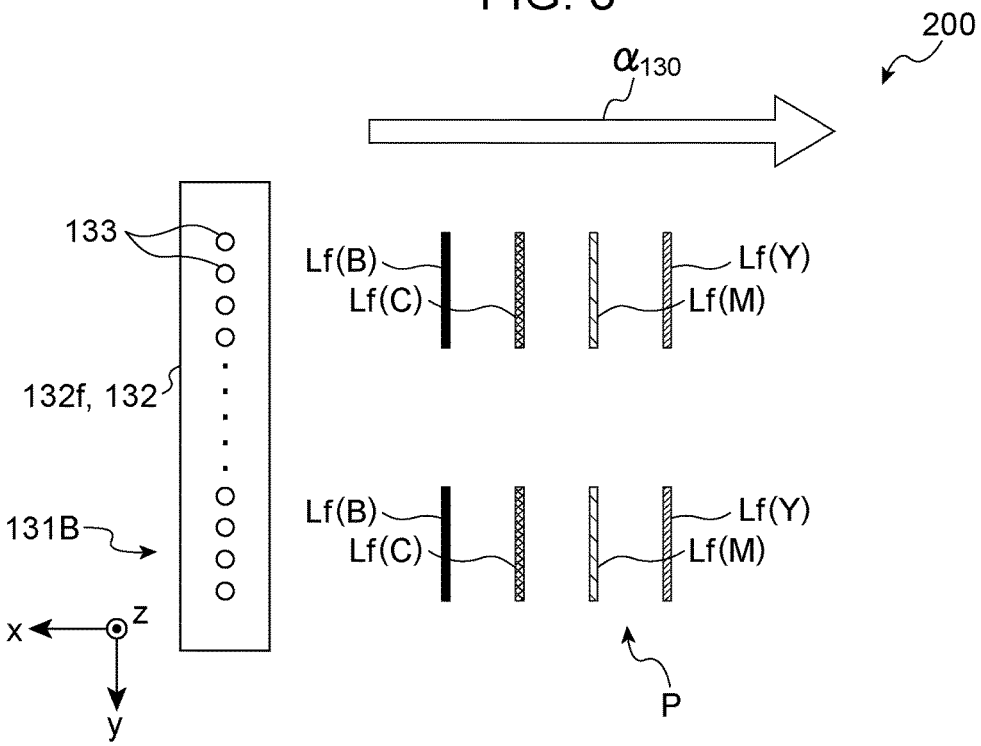
FIG. 8 is a view illustrating a state in which a head provided in the carriage unit illustrated in FIG. 7 forms a test printing pattern in a going passage.
Figure 9:
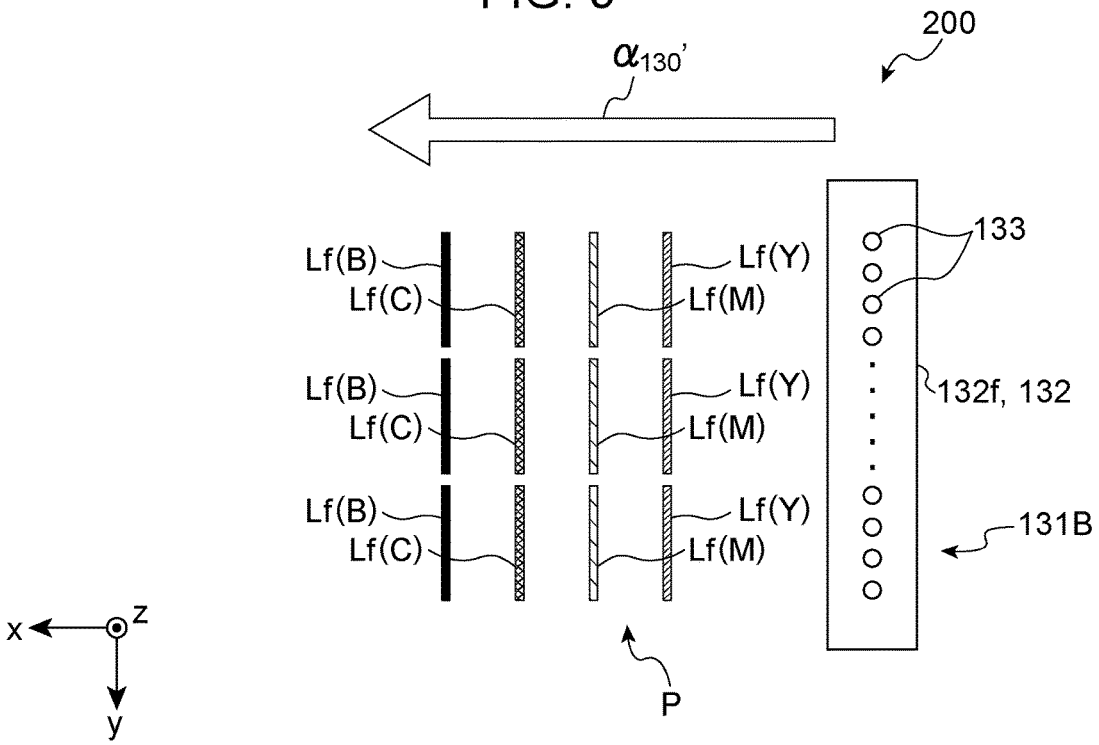
FIG. 9 is a view illustrating a state in which the head provided in the carriage unit illustrated in FIG. 7 forms the test printing pattern in a returning passage.
Figure 13:
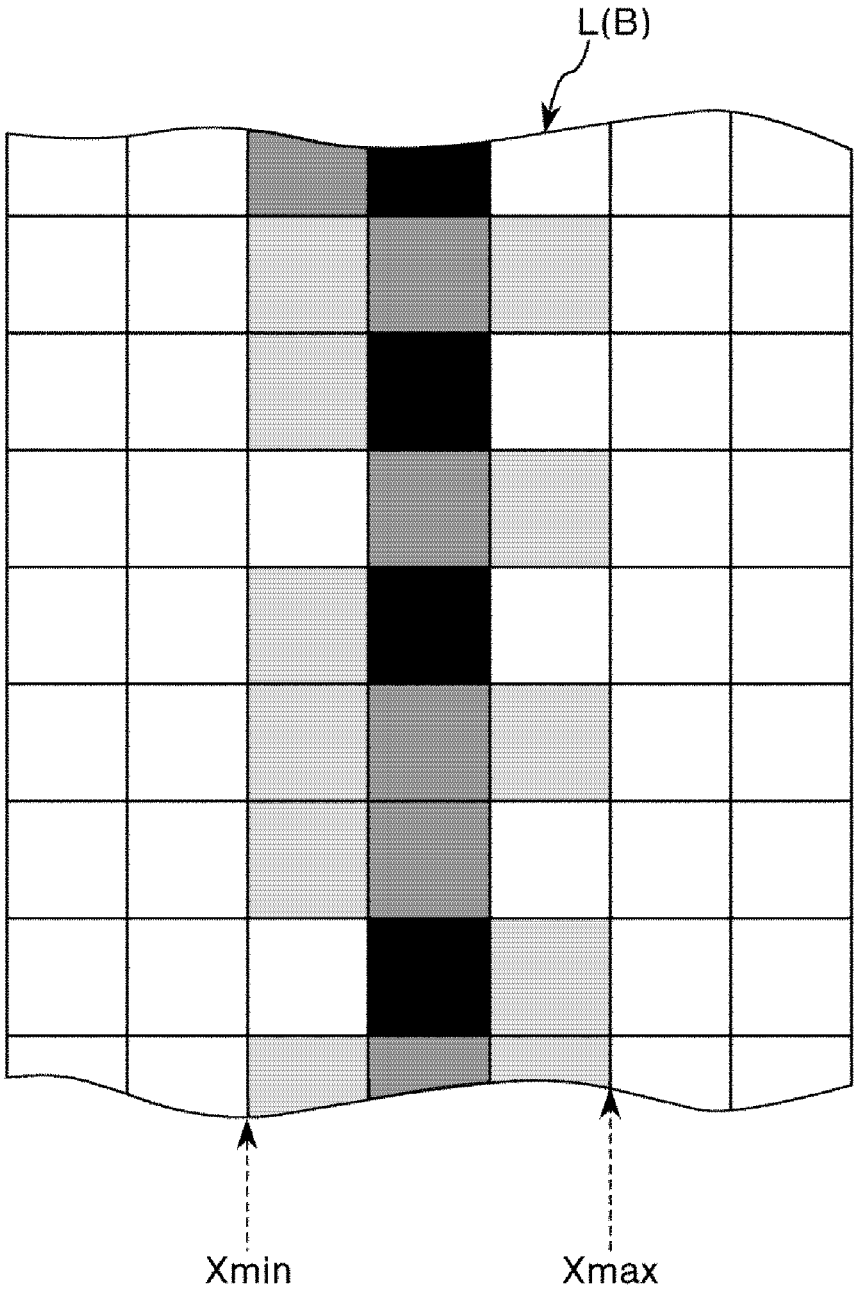
FIG. 13 is a view illustrating a part of an image in which a ruled line in the test printing pattern is read.
Figure 16:
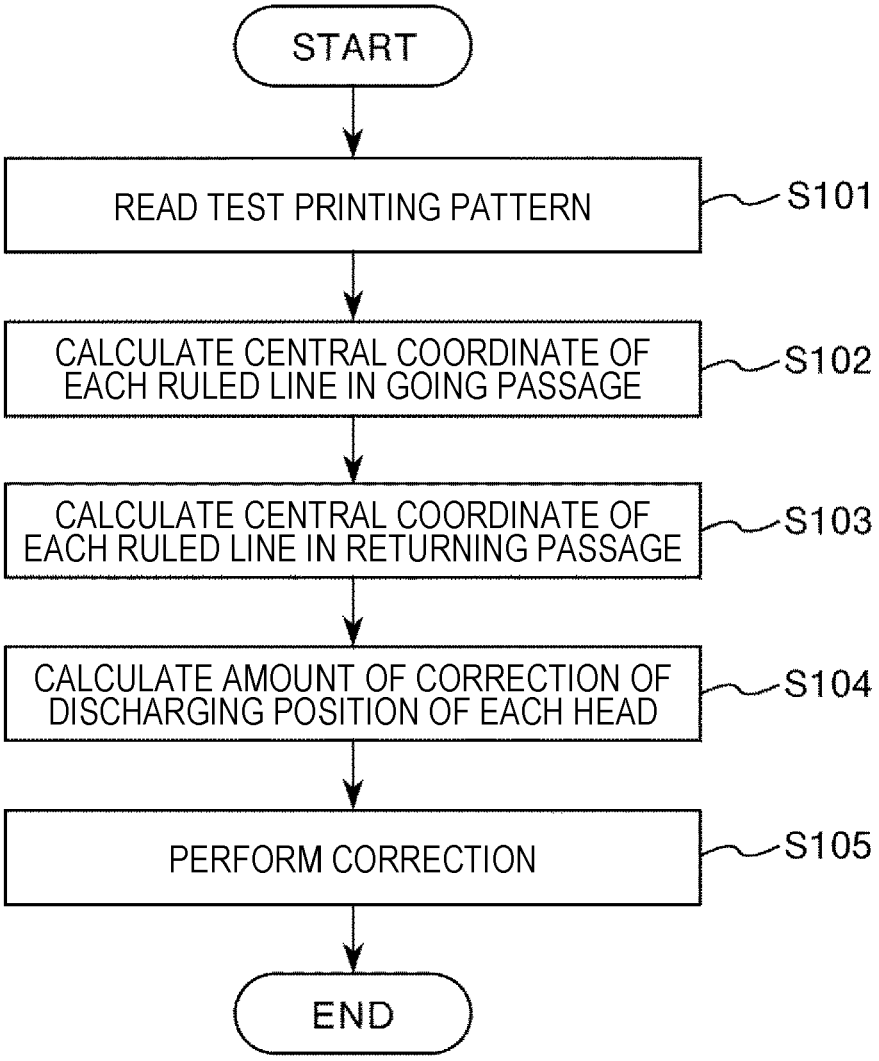
FIG. 16 is a flow chart illustrating a control operation of a controller provided in the printing apparatus illustrated in FIG. 1.

FIG. 1 is a schematic side view illustrating a first embodiment of a printing apparatus of the invention. FIG. 2 is a block diagram of a main portion of the printing apparatus illustrated in FIG. 1. FIG. 3 is a schematic configuration view illustrating a state in which the printing apparatus illustrated in FIG. 1 performs a test printing, and is a view illustrating a state in which a test medium is mounted on a mounting portion. FIG. 4 is a schematic configuration view illustrating the state in which the printing apparatus illustrated in FIG. 1 performs the test printing, and is a view illustrating a state in which the test printing is completed. FIG. 5 is a schematic configuration view illustrating the state in which the printing apparatus illustrated in FIG. 1 performs the test printing, and is a view illustrating a state in which the test medium is taken out from the mounting portion. FIG. 6 is a view illustrating a carriage unit provided in the printing apparatus illustrated in FIG. 1. FIG. 7 is a view illustrating a carriage unit provided in the printing apparatus illustrated in FIG. 1. FIG. 8 is a view illustrating a state in which a head provided in the carriage unit illustrated in FIG. 7 forms a test printing pattern in a going passage. FIG. 9 is a view illustrating a state in which the head provided in the carriage unit illustrated in FIG. 7 forms the test printing pattern in a returning passage. FIG. 10 is a view illustrating a state in which the test printing pattern is formed on the test medium. FIG. 11 is a view illustrating the state in which the test printing pattern is formed on the test medium. FIG. 12 is a view illustrating the state in which the test printing pattern is formed on the test medium. FIG. 13 is a view illustrating a part of an image in which a ruled line in the test printing pattern is read. FIG. 14 is a view illustrating central coordinates of the ruled line in a plan view of the test medium. FIG. 15 is a table illustrating an amount of correction of a discharging position of a head in a first correction and a second correction. FIG. 16 is a flow chart illustrating a control operation a controller provided in the printing apparatus illustrated in FIG. 1.

Also, hereinafter, for convenience of description, a depth direction of a paper surface in FIG. 1 is referred to as an "x direction", a horizontal direction is referred to as a "y direction", and a vertical direction is referred to as a "z direction". A direction that an arrow of each direction points is referred to as "positive", and an opposite direction thereof is referred to as "negative". In addition, coordinate axes of FIGS. 3 to 12, and 14 (same in FIG. 17) respectively correspond to a coordinate axis in FIG. 1.

A printing method of the invention is a printing method that includes a printing process performing printing on a work W as a recording medium, and in the printing process, a printing apparatus is used, which includes head units 131B, 131C, 131M, and 131Y in which a plurality of heads 132 discharging inks 100 are disposed side by side, and discharges the inks 100 while relatively moving the head units 131B, 131C, 131M, and 131Y and the work W. In addition, the head units 131B, 131C, 131M, and 131Y are logically divided into at least three groups of a first group G1, a second group G2, and a third group G3 in a direction where the plurality of heads 132 are positioned side by side, the first group G1 and the second group G2 share one head 132, the head 132 being shared is set as a first reference head, and the second group G2 and the third group G3 share one head 132, and the head 132 being shared is set as a second reference head.

Also, in the printing process, a first correction is performed in which discharging positions, where a first correction target head other than the first reference head among the heads 132 of the first group G1 and a second correction target head other than the first reference head among the heads 132 of the second group G2 discharge the inks 100, are corrected based on a discharging position where the first reference head discharges the inks, and a second correction is performed in which a discharging position, where a third correction target head other than a second reference head among the heads 132 of the third group G3 discharges the inks 100, is corrected based on a position where the first reference head discharges the inks and a position being printed by the second reference head.

Accordingly, the discharging positions of the heads of the first group and the second group are corrected based on a first reference printing pattern, the discharging positions of the heads of the third group are corrected based on the first reference printing pattern and a second reference printing pattern, and thus the discharging positions of the heads of the third group can be accurately corrected. As a result, the printing can be clearly performed. Particularly, in a case in which the carriage unit 130 is relatively large, the first reference head of the first group G1 and the heads 132 of the third group G3 are relatively separated, and the discharging positions of the heads 132 of the third group G3 are difficult to be accurately corrected, but the invention is particularly effective in such a case.

A printing apparatus 1 of the invention includes the head units 131B, 131C, 131M, and 131Y in which the plurality of heads 132 discharging the inks 100 are disposed side by side, and discharges the inks 100 while moving the head units 131B, 131C, 131M, and 131Y.

In addition, the printing apparatus 1 includes a controller 15. When the head units 131B, 131C, 131M, and 131Y are divided into three groups of the first group G1, the second group G2, and the third group G3 in a direction where the plurality of heads 132 are positioned side by side, at that time, the head units are divided so that the first group G1 and the second group G2 share one head, the second group G2 and the third group G3 share one head 132, the head 132 being shared by the first group G1 and the second group G2 is set as the first reference head, and the head 132 shared by the second group G2 and the third group G3 is set as the second reference head, the controller 15 performs the first correction in which the discharging positions, where the first correction target head other than the first reference head among the heads 132 of the first group G1 and the second correction target head other than the first reference head among the heads 132 of the second group G2 discharge the inks 100, are corrected based on the discharging position where the first reference head discharges the inks, and the second correction in which the discharging position, where the third correction target head other than the second reference head among the heads 132 of the third group G3 discharges the inks 100, is corrected based on the position where the first reference head discharges the inks and the position printed by the second reference head.

Accordingly, the effect of the invention described above can be exerted.

In addition, as illustrated in FIG. 12, a printing pattern (test printing pattern P) of the invention is a printing pattern being printed by the printing apparatus 1, which includes a head unit in which the plurality of heads 132 discharging the inks 100 are disposed side by side, and discharges the inks 100 toward the work W while transporting the work W in a direction intersecting a direction where the heads 132 are positioned side by side, and when the head unit is logically divided into at least two logical group of the first group G1 and the second group G2 sharing at least one head 132 in a direction where the plurality of heads are positioned side by side, a first test printing pattern P1 being printed by the first group G1 and a second test printing pattern P2 being printed by the second group G2 are disposed side by side along a direction intersecting the transporting direction of the work W.

When the test printing is performed using such a printing pattern, the discharging position of each head can be easily and accurately corrected. As a result, the printing can be clearly performed.

As illustrated in FIGS. 1 and 2, the printing apparatus 1 performs a printing method of the invention, and is provided with a machine base 11, a transporting portion (transporting belt) 12 transporting the work W as a recording medium, a printing portion (recording portion) 13 performing printing by applying the inks 100 onto the work W, a drying portion 2 drying the inks 100 on the work W, and a lifting mechanism 14.

In the embodiment, a direction orthogonal to the transporting direction where the work W is transported is set as an x axis direction, a direction parallel to the transporting direction is set as a y axis direction, and a direction orthogonal to the x axis direction and the y axis direction is set as a z axis direction.

The transporting portion 12 is provided with a feeding device 3 which feeds the long work W wound around in a roll shape, a winding device 4 which winds the printed work W, and a supporting device 5 which is disposed on the machine base 11 and supports the work W at the time of printing.

The feeding device 3 is disposed on an upstream side of the machine base 11 in a sending direction (y axis direction) of the work W. The feeding device 3 includes a sending roller (feeding roller) 31 in which the work W is wound in a roll shape and sends the work W, and a tensioner 32 applying tension to the work W between the sending roller 31 and the supporting device 5. A motor (not illustrated) is connected to the sending roller 31, and the sending roller 31 can be rotated by an operation of the motor.

In addition, as the work W, materials to be printed can be used. The materials to be printed means fabrics, clothes, other clothing products, or the like which is a target to be printed. The fabrics include natural fibers such as cotton, silk, and wool, chemical fibers such as nylon, or composite fibers such as woven fabrics, knitted fabrics, or nonwoven fabrics obtained by mixing the fibers described above. In addition, as clothes or other clothing products, fabrics or the like before and after cutting which presents as parts in a state of before sewing are also included, in addition to types of furniture such as T-shirts, handkerchiefs, scarves, towels, handbags, fabric bags, curtains, sheets, or bed covers after sewing.

Also, as the work W, in addition to the materials to be printed described above, paper for ink jet recording such as plain paper, high quality paper, and glossy paper can be used. In addition, as the work W, for example, a material in which plastic is coated on a base material such as a plastic film for ink jet printing on which a surface thereof is not processed (that is, ink absorbing layer is not formed) and a paper, and a material in which a plastic film is adhered can be used. As the plastic, it is not particularly limited, and for example, there are polyvinyl chloride, polyethylene terephthalate, polycarbonate, polystyrene, polyurethane, polyethylene, and polypropylene.

The winding device 4 is disposed on a downstream side of the machine base 11 in the feeding direction (y axis direction) of the work W with respect to the feeding device 3. The winding device 4 includes a winding roller (winding reel) 41 which winds the work W in a roll shape, and tensioners 42 and 44 which apply tension to the work W between the winding roller 41 and the supporting device 5. A motor (not illustrated) is connected to the winding roller 41, and the winding roller can be rotated by an operation of the motor. The tensioners 42 and 44 are sequentially disposed at an interval in a direction where the tensioners are respectively distant away from the winding roller 41.

The supporting device 5 is disposed between the feeding device 3 and the winding device 4. The supporting device 5 includes a driving roller 51 and a driven roller 52 which are disposed to be distant away from each other in the y axis direction, an endless belt 53 which is disposed over the driving roller 51 and the driven roller 52 and supports the work W on a upper surface (supporting surface), and a pressurizing roller 54 which presses and fixes the work W to the belt.

A motor (not illustrated) is connected to the driving roller 51, and the driving roller can be rotated by the operation of the motor. In addition, a rotation force of the driving roller 51 is transmitted to the driven roller 52 through the endless belt 53, and thus the driven roller 52 can be rotated in conjunction with the driving roller 51.

The endless belt 53 is a belt on which an adhesive layer having adhesiveness is formed on a front side of the surface. A part of the work W is adhered and fixed to the adhesive layer, and is transported in the y axis direction. Also, during the transporting, printing is performed on the work W. In addition, after printing is performed, the work W is peeled off from the endless belt 53.

The printing portion 13 illustrated in FIG. 1 includes a carriage unit 130 which performs recording due to printing by discharging the inks 100 onto the work W.

As illustrated in FIGS. 6 and 7, the carriage unit 130 includes the head unit 131B discharging the ink 100 of black (B), the head unit 131C discharging the ink 100 of cyan (C), the head unit 131M discharging the ink 100 of magenta (M), and the head unit 131Y discharging the ink 100 of yellow (Y). The head unit 131B, the head unit 131C, the head unit 131M, and the head unit 131Y are sequentially disposed side by side from a positive side of the x axis direction.

Since the head unit 131B, the head unit 131C, the head unit 131M, and the head unit 131Y have the same configuration except that colors of the inks 100 being discharged are different from each other, and hereinafter, the head unit 131B will be representatively described.

The head unit 131B includes a plurality of heads 132 (16 heads in the embodiment). Each head 132 includes a plurality of nozzles 133, and each of the nozzles 133 is aligned in the y axis direction (one direction) (refer to FIG. 8).

In the head unit 131B, a piezoelectric element (piezoelectric member) corresponding to each discharging nozzle is provided, and the inks 100 are discharged as droplets from each nozzle 133 when a voltage is applied to the piezoelectric element.

Also, the carriage unit 130 is standby at a position (standby position) deviated from the work W (endless belt 53) in a state of not discharging the inks 100, seen from the z axis direction.

The printing apparatus 1 intermittently sends (sub-scans) the work W in the y axis direction in a fixing state in which the work W fed by the feeding device 3 is adhered and fixed to the endless belt 53, and discharges the inks 100 from the carriage unit 130 while reciprocating (main-scanning) the carriage unit 130 in the x axis direction with respect to the work W in the fixing state. This process can be performed until printing is completed and an image pattern is formed on the work W. Also, the image pattern may be made by a multicolor-printing (color printing) manner or a monochromatic printing manner.

As the inks 100, for example, there are four colors of cyan (C), magenta (M), yellow (Y), and black (B) including a dye or pigment as a colorant in water as a solvent. Also, each color of the inks 100 are independently discharged from the heads 132.

The lifting mechanism 14 illustrated in FIGS. 1 and 2 is capable of adjusting a height of the carriage unit 130. The lifting mechanism 14 can be configured with, for example, a motor, a ball screw, and a linear guide. In addition, in the motor, an encoder is built in. The height of the carriage unit 130 can be detected based on an amount of rotation detected by the encoder. Such a lifting mechanism 14 is also electrically connected to the controller 15.

As seen from the above, the lifting mechanism 14 is capable of changing a separating distance between the carriage unit 130 and the work W. Accordingly, printing can be appropriately performed depending on a material of the work W. Further, at the time of using the test medium 200 having different thickness from the work W, a separating distance between the test medium 200 and the heads 132 at the time of the test printing is adjusted so as to be equal to a separating distance between the work W and the heads 132.

As illustrated in FIG. 1, the drying portion 2 is positioned on a downstream side of the printing portion 13 in the transporting direction of the work W, and disposed between the supporting device 5 and the winding roller 41 of the winding device 4.

The drying portion 2 includes a chamber 21, and a coil 22 disposed inside the chamber 21. The coil 22 is made of, for example, a nichrome wire, and is a heating element that generates heat by supplying electricity. Also, the inks 100 on the work W passing through the chamber 21 can be dried due to heat generated by the coil 22.

A supporting portion 16 supporting the endless belt 53 (transporting belt) from the inside is provided inside the endless belt 53 and an upstream side of the printing portion 13 in the transporting direction. Therefore, in the endless belt 53 (belt), a part being supported by the supporting portion 16 functions as the mounting portion 17. Accordingly, the test medium 200 to be described later can be stably mounted on the mounting portion 17.

The supporting portion 16 is an iron plate provided inside the endless belt 53, and has a plate shape having higher stiffness than the endless belt 53 (transporting belt). At the time of mounting the test medium 200, even when the test medium 200 is pressed from the top, it is possible to prevent the belt 53 from being deformed because the supporting portion supports the belt. In addition, the supporting portion 16 has a size of a degree, that is capable of sufficiently covering the test medium 200 in plan view thereof. Accordingly, the test medium 200 to be described later can be stably mounted on the mounting portion 17, and deformation of the test medium 200 is prevented, and thereby a test pattern can be more accurately printed. Also, in the endless belt 53, a flat part supported by the supporting portion 16 can be also referred to as a guide portion.

As illustrated in FIG. 2, the controller (adjusting section) 15 is electrically connected to the drying portion 2, the transporting portion 12, the printing portion 13, and the lifting mechanism 14, and has a function of controlling operations of these component. In addition, the controller 15 includes a central processing unit (CPU) 151, and a storage portion 152.

The CPU 151 executes programs for various processes such as the printing process described above.

The storage portion 152 includes, for example an electrically erasable programmable read-only memory (EEPROM) or the like which is a type of nonvolatile semiconductor memory, and is capable of storing various programs and the like.

Such a printing apparatus 1 is covered with a cover 18. The cover 18 covers at least the transporting portion 12 and the printing portion 13. Accordingly, the transporting portion 12 and the printing portion 13 can be protected.

In addition, an opening portion 181 is provided in the cover 18, which penetrates the cover in a thickness direction thereof. The opening portion 181 is provided on the upstream side of the printing portion 13 in the transporting direction of the work W. The test medium 200 can be mounted on the mounting portion 17 through the opening portion 181.

As illustrated in FIGS. 3 to 5, the printing apparatus 1 described above performs a test printing using the test medium 200 before performing printing on the work W. Also, the test medium 200 on which the test printing is performed is read by a scanner as an image, and the discharging position of each head 131 is corrected based on the image. Such a test printing and correction of the discharging position are performed, and thus printing can be performed on the work W with high accurately.

First, before describing the test printing and the correction of the discharging position, the test medium 200 will be described. The test medium 200 has a rectangular sheet shape in which a length is approximately 400 mm, and a width is approximately 250 mm. The test medium 200 is paper having higher stiffness than the work W (recording medium). Accordingly, the test medium 200 can be more difficult to be deformed than the work W, and thus the test printing can be more accurately performed than a case printing is performed on the work W. The test medium 200 may have a size which can be read by the scanner, or smaller size. Meanwhile, in consideration of adjusting all the heads 132, it is desirable that the size is greater than a carriage capable of mounting all the heads 132. As the printing apparatus 1 of the embodiment, in a case in which the carriage is greater than the size, in order to adjust all the heads 132, the test printing pattern is used by being divided using a method to be described later.

Next, the test printing will be described.

First, as illustrated in FIG. 3, the test medium 200 is disposed on the mounting portion 17. At this time, the test medium 200 can be disposed by inserting a hand to the inside of the cover 18 through the opening portion 181 of the cover 18 from the outside. That is, the opening portion 181 provided on the cover (cover member) 18 functions as a guide portion which guides the test medium 200 to the mounting portion 17 when the test medium 200 is mounted on the mounting portion 17. Accordingly, the test medium 200 can be easily mounted on the mounting portion 17.

In addition, the opening portion 181 is provided on the upstream side of the printing portion 13 in the transporting direction of the work W (recording medium). Accordingly, the test medium 200 can be easily mounted on the mounting portion 17 which is provided on the upstream side of the printing portion 13 in the transporting direction.

Next, as illustrated in FIG. 4, a test printing pattern to be described later is printed while the test medium 200 is transported on a y axis positive side by rotating the driving roller 51 in an arrow a51 direction of FIG. 4. The test medium 200 at this time is transported by the endless belt 53, but is not applied to the driving roller 51 and the driven roller 52. The driving roller 51 and the driven roller 52 are disposed at a sufficient interval. Therefore, a flat surface portion of the endless belt 53 has a length of a degree at which the test medium 200 does not reach either of the driving roller 51 or the driven roller 52 during the test printing. Accordingly, the test medium 200 is deformed during the test printing in accordance with the driving roller 51 or the driven roller 52, and applying tension to the test medium 200 can be prevented. Accordingly, the test printing can be more accurately performed.

Also, as illustrated in FIG. 5, the test medium 200 is transported to a y axis negative side until the test medium 200 is positioned on the mounting portion 17 by rotating the driving roller 51 in an arrow a51' direction of FIG. 5. Also, the test medium 200 is taken out through the opening portion 181.

The test printing is performed as described above and is read as an image using the scanner, and based on the image, the correction of the discharging position of each head 132 is performed. Hereinafter, the correction of the discharging position of each head 132 will be described.

In the correction, as illustrated in FIG. 7, the carriage unit 130 is considered to be divided into three groups of the first group G1, the second group G2, and the third group G3. Since this group division is also performed in the head unit 131B, the head unit 131C, the head unit 131M, and the head unit 131Y, hereinafter, the head unit 131B will be representatively described. Also, as illustrated in FIGS. 10 to 12, and 14, in the test medium 200, a reference line at the time of reading by the scanner is attached in a vertical direction and a horizontal direction in drawings. Accordingly, reading can be accurately performed.

In the head unit 131B, as described above, 16 heads 132 are disposed side by side. Each head 132 means, in order from a lower side of FIGS. 6 and 7, a head 132*a*, a head 132*b*, a head 132*c*, a head 132*d*, a head 132*e*, a head 132*f*, a head 132*g*, a head 132*h*, a head 132*i*, a head 132*j*, a head 132*k*, a head 132L, a head 132*m*, a head 132*n*, a head 132*o*, and a head 132*p*.

Among the heads 132, the head 132*a*, the head 132*b*, the head 132*c*, the head 132*d*, the head 132*e*, and the head 132*f* are set as the first group G1. In addition, among these heads 132, the head 132*f*, the head 132*g*, the head 132*h*, the head 132*i*, the head 132*j*, and the head 132*k* are set as the second group G2. In addition, among these heads 132, the head 132*k*, the head 132L, the head 132*m*, the head 132*n*, the head 132*o*, and the head 132*p* are set as the third group G3.

As seen from the above, the first group G1 and the second group G2 share one head 132*f*, the head 132*f* being shared is set as a first reference head, the second group G2 and the third group G3 share one head 132*k*, and the head 132*k* being shared is set as a second reference head.

Also, the head 132*a*, the head 132*b*, the head 132*c*, the head 132*d*, and the head 132*e* are the first correction target head, the head 132*g*, the head 132*h*, the head 132*i*, and the head 132*j* are the second correction target head, and the head 132L, the head 132*m*, the head 132*n*, the head 132*o*, and the head 132*p* are the third correction target head.

After the heads are divided into groups as described above, the test printing, that is, a test printing process (printing process) is performed. Hereinafter, the test printing pattern P being printed during the test printing will be described with reference to FIG. 8.

FIG. 8 is a plan view of the test medium 200, and is a view illustrating a part of the test printing pattern P printed on the test medium 200. In addition, in FIG. 8, the head 132*f* among these heads 132 is representatively illustrated.

First, as illustrated in FIG. 8, in the going passage, that is, while moving the head unit 131B in an arrow $\alpha_{130}$ direction in FIG. 8, two ruled lines L (B) are printed using the head 132*f* of the head unit 131B. The two ruled lines L (B) are printed side by side along the y axis direction. Each ruled line L (B) is printed by discharging the inks 100 from the nozzles 133 at a position corresponding to two ruled lines L (B) among a plurality of nozzles 133 of the head 132*f* of the head unit 131B.

Next, as illustrated in FIG. 9, in the returning passage, that is, one ruled line L (B) is printed using the head 132*f* of the head unit 131B while moving the head unit 131B in an arrow $\alpha_{130}'$ direction of FIG. 9. The one ruled line L (B) is printed between the printed two ruled lines L (B).

Three ruled lines L (B) are formed by such reciprocating the head once. Also, each head may form the three ruled lines L (B) along the Y axis direction in order of the going passage, the returning passage, and the going passage, or in order of the returning passage, the going passage, and the returning passage, or these two patterns may be mixed. If there is a position deviation such as rotation of each head 132 in a Z axis direction, when the two patterns are mixed, an error of inclination can be reduced, but as the embodiment, even when all the heads 132 forms the three ruled lines L (B) along the Y axis direction in order of the going passage, the returning passage, and the going passage, the inclination also can be reduced. This is because that the position deviation of the center of each ruled line can be more reduced by forming three ruled lines than a case of forming two lines.

Also, it is not illustrated, but even in the head 132*f* of the head unit 131C, three ruled lines L (C) are printed on an x axis direction negative side of the ruled lines L (B) in the same manner as the head 132*f* of the head unit 131B.

In addition, it is not illustrated, even in the head 132*f* of the head unit 131M, three ruled lines L (M) are printed on the x axis direction negative side of the ruled line L (C) in the same manner as the head 132*f* of the head unit 131B.

In addition, it is not illustrated, even in the head 132*f* of the head unit 131Y, three ruled lines L (Y) are printed on the x axis direction negative side of the ruled line L (M) in the same manner as the head 132*f* of the head unit 131B.

Also, the ruled line L (C), the ruled line L (M), and the ruled line L (Y) are printed in a passage the same as a passage where the ruled line L (B) is printed, that is, is printed in one round trip of the going passage and the returning passage.

Also, in the above description, the head 132*f* is described, but as illustrated in FIG. 10, even in the head 132*a*, the head 132*b*, the head 132*c*, the head 132*d*, and the head 132*e*, each ruled line is printed by discharging the inks 100 in the same manner as the head 132*f* which prints each ruled line. Accordingly, as illustrated in FIG. 10, the test printing pattern P1 is formed on the test medium 200 by the head 132*a*, the head 132*b*, the head 132*c*, the head 132*d*, the head 132*e*, and the head 132*f*.

Also, after the test medium 200 is moved on a downstream side of the transporting direction, as illustrated in FIG. 11, the test printing pattern P2 is printed using the head 132*f*, the head 132*g*, the head 132*h*, the head 132*i*, the head 132*j*, and the head 132*k*, in the same manner as the test printing pattern P1. The test printing pattern P2 is formed on the x axis direction negative side of the test printing pattern P1.

Also, after the test medium 200 is further moved on the downstream side of the transporting direction, as illustrated in FIG. 12, a test printing pattern P3 is printed using the head 132*k*, the head 132L, the head 132*m*, the head 132*n*, the head 132*o*, and the head 132*p* in the same manner as the test printing pattern P1 and the test printing pattern P2. The test printing pattern P3 is formed on the x axis direction negative side of the test printing pattern P2.

As seen from the above, the test printing pattern P constituted by the test printing pattern P1, the test printing pattern P2, and the test printing pattern P3 is printed.

Also, the ruled line printed by the head 132*f* is the first reference printing pattern, the ruled line printed by the head 132*k* is the second reference printing pattern, ruled lines printed by the head 132*a*, the head 132*b*, the head 132*c*, the head 132*d*, and the head 132*e* are a first correction target pattern, ruled lines printed by the head 132*g*, the head 132*h*, the head 132*i*, and the head 132*j* are a second correction target pattern, and ruled lines printed by the head 132L, the head 132*m*, the head 132*n*, the head 132*o*, and the head 132*p* are a third correction target pattern.

The first reference printing pattern, the second reference printing pattern, the first correction target pattern, the second correction target pattern, and the third correction target pattern respectively have a linear shape along the y axis direction (one direction). Accordingly, the center of each ruled line can be easily detected.

Next, control operations of the controller in the correction of the discharging position using the test medium 200 on which such a test printing pattern P is printed will be described. Hereinafter, the correction will be described based on a flow chart illustrated in FIG. 16.

First, in Step S101, the test printing pattern P is read by the scanner as an image. Also, correction is performed based on the read image in steps as follows.

Next, in Step S102, central coordinates in the x axis direction of the ruled line L (B), the ruled line L (C), the ruled line L (M), and the ruled line L (Y) in the going passage of the head 132*a*, the head 132*b*, the head 132*c*, the head 132*d*, the head 132*e*, the head 132*f*, the head 132*g*, the head 132*h*, the head 132*i*, the head 132*j*, the head 132*k*, the head 132L, the head 132*m*, the head 132*n*, the head 132*o*, and the head 132*p* are respectively calculated.

Hereinafter, the calculation of the central coordinates is described; however, the ruled line L (B) of the head 132*f* will be representatively described.

First, as illustrated in FIG. 13, in the ruled line L (B), a coordinate Xmax positioned on the most x axis direction positive side is detected, and a coordinate Xmin positioned on the most x axis direction negative side is detected. Also, a center point in the x axis direction of the coordinate Xmax and the coordinate Xmin is detected. That is, (Xmax+Xmin)/2 is calculated. A calculated result is set as a central coordinate.

In addition, in Step S102, in the same manner as the ruled line L (B), central coordinates of the ruled line L (C), the ruled line L (M), and a ruled line L (Y) in all the going passages are calculated.

Also, in FIG. 14, each of the ruled line L (B), the ruled line L (C), the ruled line L (M), and the ruled line L (Y) of the head 132*a*, the head 132*b*, the head 132*c*, the head 132*d*, the head 132*e*, the head 132*f*, the head 132*g*, the head 132*h*, the head 132*i*, the head 132*j*, the head 132*k*, the head 132L, the head 132*m*, the head 132*n*, the head 132*o*, and the head 132*p* is the same mark, and thus the mark of the ruled line L (B) is representatively illustrated.

Next, in Step S103, central coordinates in the x axis direction of the ruled line L (B), the ruled line L (C), the ruled line L (M), and the ruled line L (Y) in the returning passage of the head 132*a*, the head 132*b*, the head 132*c*, the head 132*d*, the head 132*e*, the head 132*f*, the head 132*g*, the head 132*h*, the head 132*i*, the head 132*j*, the head 132*k*, the head 132L, the head 132*m*, the head 132*n*, the head 132*o*, and the head 132*p* are calculated.

Also, in Step S103, in the same manner as Step S102, the central coordinates are respectively calculated.

Next, in Step S104, an amount of correction of the discharging position of each head 132 is calculated. In this step, the correction is performed in each of the first group G1, the second group G2, and the third group G3 described above. Hereinafter, this correction will be described based on a table illustrated in FIG. 15. Also, since correction methods of the ruled line L (B), the ruled line L (C), the ruled line L (M), and the ruled line L (Y) are the same, hereinafter, the ruled line L (B) will be representatively described. In addition, the ruled line L (B) will be representatively described even in the table illustrated in FIG. 15.

Also, hereinafter, as illustrated in FIG. 14, the central coordinate of the ruled line L (B) of the going passage of the head 132*a* is set as X1, the central coordinate of the ruled line L (B) of the going passage of the head 132*b* is set as X2, the central coordinate of the ruled line L (B) of the going passage of the head 132*c* is set as X3, the central coordinate of the ruled line L (B) of the going passage of the head 132*d* is set as X4, the central coordinate of the ruled line L (B) of the going passage of the head 132*e* is set as X5, the central coordinate of the ruled line L (B) of the going passage of the head 132*f* is set as X6, the central coordinate of the ruled line L (B) of the going passage of the head 132*g* is set as X7, the central coordinate of the ruled line L (B) of the going passage of the head 132*h* is set as X8, the central coordinate of the ruled line L (B) of the going passage of the head 132*i* is set as X9, the central coordinate of the ruled line L (B) of the going passage of the head 132*j* is set as X10, the central coordinate of the ruled line L (B) of the going passage of the head 132*k* is set as X11, the central coordinate of the ruled line L (B) of the going passage of the head 132L is set as X12, the central coordinate of the ruled line L (B) of the going passage of the head 132*m* is set as X13, the central coordinate of the ruled line L (B) of the going passage of the head 132*n* is set as X14, the central coordinate of the ruled line L (B) of the going passage of the head 132*o* is set as X15, and the central coordinate of the ruled line L (B) of the going passage of the head 132*p* is set as X16.

First, the correction of the discharging position of the head 132 of the first group G1, that is, the head 132*a*, the head 132*b*, the head 132*c*, the head 132*d*, the head 132*e*, and the head 132*f* will be described.

The amount of correction of the going passage of the head 132*a* is a value obtained by subtracting the central coordinate of the ruled line L (B) of the head 132*f* from the central coordinate of the ruled line L (B) of the head 132*a*, that is, X1-X6 is the amount of correction.

In the same manner, the amount of correction of the going passage of the head 132*b* is set as X2-X6. The amount of correction of the going passage of the head 132*c* is set as X3-X6. The amount of correction of the going passage of the head 132*d* is set as X4-X6. The amount of correction of the going passage of the head 132*e* is set as X5-X6. Also, the amount of correction of the going passage of the head 132*f* is set as X6-X6, that is, the head 132*f* is a first reference, and thus the correction of the discharging position is not performed thereon.

As seen from the above, the central coordinate X6 of the ruled line L (B) of the head 132*f*, which is the first correction target pattern is set to a reference, the amounts of correction of the discharging positions of the head 132*a*, the head 132*b*, the head 132*c*, the head 132*d*, and the head 132*e* are calculated.

Next, correction of the head 132 of the second group G2 will be described.

The correction of the head 132 of the second group G2 is performed based on the central coordinate X6 of the ruled line L (B) of the head 132*f* of the test printing pattern P2, which is printed as the second group G2, as a reference.

The amount of correction of the head 132*f* is set as X6-X6, that is, since the head 132*f* is the first reference, the correction of the discharging position is not performed. The amount of correction of the going passage of the head 132*g* is set as X7-X6. The amount of correction of the going passage of the head 132*h* is set as X8-X6. The amount of correction of the going passage of the head 132*i* is set as X9-X6. The amount of correction of the going passage of the head 132*j* is set as X10-X6. The amount of correction of the going passage of the head 132*k* is set as X11-X6. As seen from the above, the amounts of correction of the discharging positions of the head 132*g*, the head 132*h*, the head 132*i*, the head 132*j*, and the head 132*k* are calculated based on the central coordinate X6 of the ruled line L (B) of the head 132*f*, which is the first correction target pattern, as a reference.

Here, in general, since a range in which the scanner is capable of performing reading at one time becomes a length of the Y axis direction of the test printing pattern P1 (same as even in test printing pattern P2 and the test printing pattern P3), the correction of the heads 132 of the second group G2 is performed based on the central coordinate X6 of the ruled line L (B) of the head 132*f* of the test printing pattern P2, which is printed as the second group G2, as a reference, and thus the heads 132 of the second group G2 are capable of printing at the same degree as the heads of the first group G1. That is, even when the correction in the first group G1 and the second group G2 are performed with not one reading image but different reading images from each other, the correction can be accurately performed in the same as a case of correcting with one reading image.

Next, correction of the heads 132 of the third group G3 will be described.

The correction of the heads 132 of the third group G3 is performed based on the ruled line L (B) of the head 132*f* which is the first reference printing pattern and the ruled line L (B) of the head 132*k* which is the second reference printing pattern.

Correction of the head 132L is performed based on the central coordinate X6 of the ruled line L (B) of the head 132*f* and the ruled line L (B) of the head 132*k* as a reference.

The amount of correction of the head 132L is set as (X12−X11)+(X11−X6). That is, in the correction of the head 132L, first, an amount of deviation between a central coordinate X12 of the ruled line L (B) of the head 132L and a central coordinate X11 of the ruled line L (B) of the head 132*k* is calculated, and an amount of deviation between the central coordinate X11 of the ruled line L (B) of the head 132*k* and the central coordinate X6 of the ruled line L (B) of the head 132*f* is added to a calculated value thereof.

In the same manner, an amount of correction of the head 132*m* is set as (X13−X11)+(X11−X6). An amount of correction of the head 132*n* is set as (X14−X11)+(X11−X6). An amount of correction of the head 132*o* is set o (X15−X11)+(X11−X6). An amount of correction of the head 132*p* is set as (X16−X11)+(X11−X6).

Also, an amount of correction of the head 132*k* is set as (X11−X11)+(X11−X6), that is, the correction of the head 132*k* is performed based on the ruled line L (B) of the head 132*f* as a reference.

Particularly, as described above, since a range in which the scanner is capable of performing reading at one time becomes a length of the Y axis direction of the test printing pattern P1 (same as even in test printing pattern P2 and the test printing pattern P3), even when correction of the discharging positions of the heads 132 of the third group G3 is performed based on the ruled line L (B) of the head 132*f* of the first group G1, it is difficult to accurately perform the correction of the discharging position. Particularly, since the heads 132 of the third group G3 are relatively deviated from the head 132*f*, it is difficult to more accurately perform the correction of the discharging position than the correction of the second group D2. However, as described above, when the correction of the heads 132 of the third group G3 is performed based on the ruled line L (B) of the head 132*f* which is the first reference printing pattern and the ruled line L (B) of the head 132*k* which is the second reference printing pattern, even when the correction of the first group G1, the second group G2, and the third group G3 are performed with not one reading image but different reading images from each other, the correction can be accurately performed in the same as a case of correcting with one reading image.

In addition, the correction of the discharging position in the returning passage is also performed in the same manner as the correction of the discharging position on the going passage. Hereinafter, these correction will be described.

Also, hereinafter, a central coordinate of the ruled line L (B) in the returning passage of the head 132*a* is set as X1', a central coordinate of the ruled line L (B) in the returning passage of the head 132*b* is set as X2', a central coordinate of the ruled line L (B) in the returning passage of the head 132*c* is set as X3', a central coordinate of the ruled line L (B) in the returning passage of the head 132*d* is set as X4', a central coordinate of the ruled line L (B) in the returning passage of the head 132*e* is set as X5', a central coordinate of the ruled line L (B) in the returning passage of the head 132*f* is set as X6', a central coordinate of the ruled line L (B) in the returning passage of the head 132*g* is set as X7', a central coordinate of the ruled line L (B) in the returning passage of the head 132*h* is set as X8', a central coordinate of the ruled line L (B) in the returning passage of the head 132*i* is set as X9', a central coordinate of the ruled line L (B) in the returning passage of the head 132*j* is set as X10', a central coordinate of the ruled line L (B) in the returning passage of the head 132*k* is set as X11', a central coordinate of the ruled line L (B) in the returning passage of the head 132L is set as X12', a central coordinate of the ruled line L (B) in the returning passage of the head 132*m* is set as X13', a central coordinate of the ruled line L (B) in the returning passage of the head 132*n* is set as X14', a central coordinate of the ruled line L (B) in the returning passage of the head 132*o* is set as X15', and a central coordinate of the ruled line L (B) in the returning passage of the head 132*p* is set as X16'.

An amount of correction of the returning passage of the head 132*a* is X1'−X6. An amount of correction of the returning passage of the head 132*b* is X2'−X6. An amount of correction of the returning passage of the head 132*c* is X3'−X6. An amount of correction of the returning passage of the head 132*d* is X4'−X6. An amount of correction of the returning passage of the head 132*e* is X5'−X6. An amount of correction of the returning passage of the head 132*f* is X6'−X6. An amount of correction of the returning passage of the head 132*g* is X7'−X6. An amount of correction of the returning passage of the head 132*h* is X8'−X6. An amount of correction of the returning passage of the head 132*i* is X9'−X6. An amount of correction of the returning passage of the head 132*j* is X10'−X6. An amount of correction of the returning passage of the head 132*k* is X11'−X6.

The amount of correction of the returning passage of the head 132*k* is (X11'−X11)+(X11−X6). The amount of correction of the returning passage of the head 132L is (X12'−X11)+(X11−X6). The amount of correction of the returning passage of the head 132*m* is (X13'−X11)+(X11−X6). The amount of correction of the returning passage of the head 132*n* is (X14'−X11)+(X11−X6). The amount of correction of the returning passage of the head 132*o* is (X15'−X11)+(X11−X6). The amount of correction of the returning passage of the head 132*p* is (X16'−X11)+(X11−X6).

As seen from the above, even in the returning passage, the correction of the discharging positions of the heads 132 of the first group G1 and the second group G2 are performed based on the ruled line L (B) of the head 132*f*, and the correction of the discharging positions of the heads 132 of the third group G3 is performed based on the ruled line L (B) of the head 132*f* and the ruled line L (B) of the head 132*k*. That is, the first correction and the second correction are performed on both the going passage and the returning passage. Accordingly, in the same manner as the correction of the discharging position on the going passage, the correction of the discharging position can be accurately performed even in the returning passage.

In addition, the correction of the discharging position is performed on both the going passage and the returning passage based on the ruled line L (B) of the head 132*f* in the going passage or the ruled line L (B) of the head 132*k* in the going passage as a reference, and thus landing positions of the inks 100 in the going passage and the returning passage can be matched, and the control operation can be more simplified.

Also, in Step S105, based on the amount of correction calculated in Step S104, the printing is performed while correcting the discharging position of each head. Accordingly, the printing can be performed clearly.

The correction of the discharging position is performed based on an integer obtained by dividing the discharging position by a minimum resolution of the printing apparatus 1. Accordingly, the correction of the discharging position can be more accurately performed.

As seen from the above, in the test printing process (printing process), the first correction is performed in which the discharging position is changed by an amount of deviation between the central coordinate (center) of the ruled line L (B) of the head 132*k* as the first reference printing pattern and the central coordinate (center) of the ruled line L (B) which is the first correction target pattern printed by the heads of the first group G1 132, which is the first correction target head, and the discharging position is changed by an amount of deviation between the central coordinate (center) of the ruled line L (B) of the head 132*f* as the first reference printing pattern and the central coordinate (center) of the ruled line L (B) which is the second correction target pattern printed by the heads 132 as the second correction target head. Accordingly, the discharging position of the first correction target head can be accurately corrected.

In addition, in the test printing process (printing process), correction (second correction) is performed in which the discharging position is changed, by an amount obtained by adding the amount of deviation between the central coordinate (center) of the ruled line L (B) of the head 132*k* as the second reference printing pattern and the central coordinate (center) of the ruled line L (B) which is the third correction target pattern printed by the heads 132 of the third group G3, which is the third correction target head, to the amount of deviation between the central coordinate (center) of the ruled line L (B) which is the first reference printing pattern and the central coordinate (center) of the ruled line L (B) of the head 132*k* which is the second reference printing pattern. Accordingly, the correction of the discharging positions of the heads of the third group G3, which is positioned at a position distant away from the first reference head, can be accurately performed.

In addition, the printing apparatus 1 includes a plurality of the head units which respectively discharge the inks 100 having different colors from each other, and in the test printing process (printing process), the first correction and the second correction of each head unit are performed. Accordingly, the correction of the discharging position of each head unit can be accurately performed, and the correction of the discharging position of all the heads can be accurately performed.

In addition, the printing process is a test printing process which is performed before performing printing with respect to the work W as the recording medium. Accordingly, the first correction and the second correction described above can be performed before performing printing with respect to the work W, and printing on the work W can be accurately performed.

In the correction as described above, the test printing pattern P obtained by mounting the test medium 200 on the belt 53 and performing printing thereon is read as an image using the scanner by detaching the test medium 200 from the belt 53. Accordingly, when the test medium 200 is detached from the belt, or after the test medium is detached from the belt, the test medium 200 is deformed and becomes a different shape from an original medium at the time of being positioned on the belt, a shape of the test printing pattern P printed thereon is also changed, and thus the correction is not appropriately performed. In the embodiment, since the test medium 200 is paper or the like and is a member more difficult to be deformed than the work W which is a fabric, deformation of the test medium is suppressed, and correction is more accurately performed. Further, since a part in which the test medium 200 is mounted is wider than the test medium 200, and is supported by a member which is more difficult to be deformed than the belt 53, when the test medium is adhered to or peeled off from the belt, deformation of the test medium is suppressed, the correction is more appropriately performed.

In addition, since the test medium 200 is moved in the transporting direction at the time of printing the test printing patterns P1, P2, and P3 described above, but the test medium 200 is not applied to a part of a driving roller and a driven roller of the belt 53, the test medium 200 is not deformed during the test printing, and the test printing can be performed with high accuracy.

Such a test printing is generally performed before printing on the work W, but in a case in which a landing position may be deviated or nozzles may be clogged during printing, the printing on the work W can be stopped. In such a case, the test medium 200 is mounted near the work W, but the test medium 200 is mounted on the work W during printing in a case in which a width of the work W is wide and a part where the work W on the belt 53 is not applied is narrow. In addition, in a case in which the work W is sufficiently thin, the test medium 200 may be mounted so as to be applied to the belt 53 and the work W. In this case, the test medium 200 is adjusted by the lifting mechanism 14 so that a gap between the heads 132 is equal to a gap between the work W and the heads 132 at the time of printing on the work W.

Figure 18:
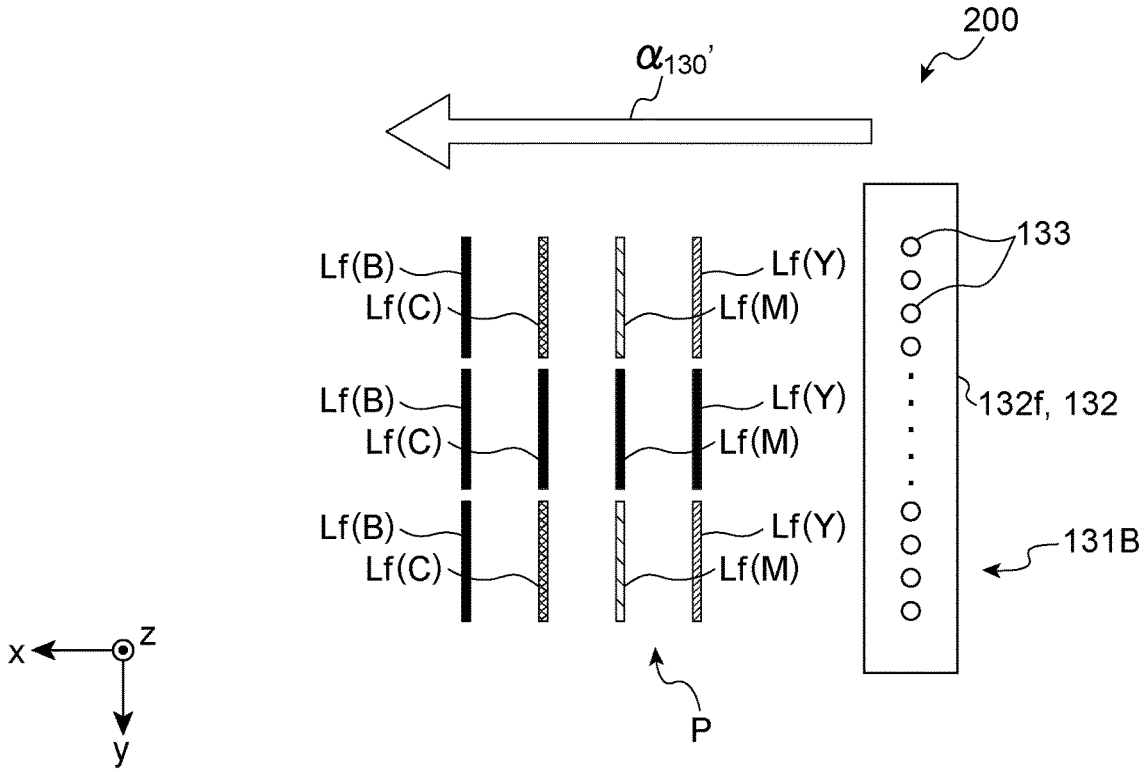
FIG. 18 is a view illustrating an example of the test printing pattern.

Also, in the test printing pattern P1, the test printing pattern P2, and the test printing pattern P3, each color is disposed in the y axis direction in one row, but in the invention, it is not limited thereto, and for example, plural types of colors may be mixed in each row (refer to FIG. 18). Accordingly, the correction can be performed between the heads 132 of each color.

Second Embodiment

Figure 17:
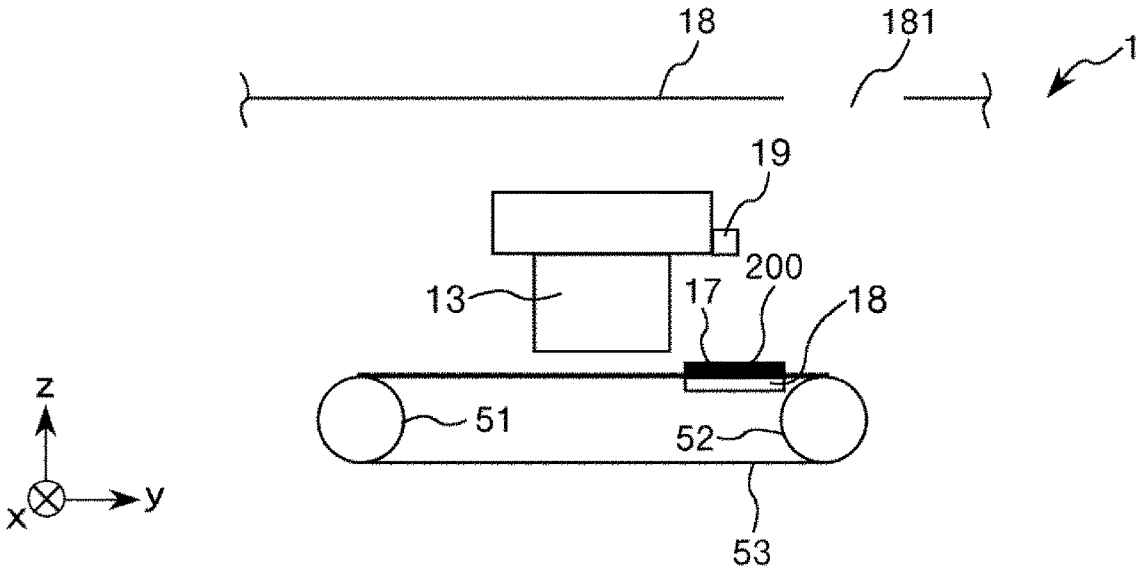
FIG. 17 is a schematic side view illustrating a second embodiment of a printing apparatus of the invention.

FIG. 17 is a schematic side view illustrating a second embodiment of the printing apparatus of the invention.

Hereinafter, the second embodiment of the printing apparatus of the invention will be described with reference to the drawing, but differences from the above-described embodiment will be mainly described, and description of similar points will be omitted.

The second embodiment is the same as the first embodiment except that a forming position of the guide portion is different.

As illustrated in FIG. 17, in the embodiment, the opening portion 181 is provided on a downstream side of the printing portion 13 in the transporting direction of the work W (recording medium). Accordingly, the test medium 200 can be easily mounted on the mounting portion 17 provided on a downstream side of the printing portion 13 in the transporting direction.

In addition, as illustrated in FIG. 17, the printing apparatus 1 of the embodiment includes the scanner 19. The scanner 19 is provided on a downstream side of the printing portion 13 in the transporting direction of the recording medium. The scanner 19 reads the test medium 200 where the inks 100 are discharged as an image. Accordingly, after the test printing is completed, as the first embodiment, a process in which the test medium 200 is taken out and is read by a separate scanner can be omitted. That is, a test printing process and a scanning process can be automatically performed.

Hitherto, the printing apparatus and the printing method of the invention are described with reference to the embodiments described above; however, the invention is not limited thereto. In addition, each portion constituting the printing apparatus can be substituted for an arbitrary configuration which exerts the same function. In addition, an arbitrary configuration material may be added.

In addition, the printing apparatus and the printing method of the invention may be a combination of arbitrary two or more configurations (features) among the above embodiments.

In addition, each color of the inks being used in the printing apparatus, is four colors in each embodiment described above, but it is not limited thereto, and for example, two colors, three colors, five colors, or more may be used.

In addition, the transporting portion includes the endless belt which fixes the work by an adhering manner in the embodiments described above, but it is not limited thereto, and for example, the transporting portion may include a platen (stage) which fixes the work by a suction manner.

This application claims priority under 35 U.S.C. § 119 to Japanese Patent Application No. 2016-237335, filed Dec. 7, 2016. The entire disclosure of Japanese Patent Application No. 2016-237335 is hereby incorporated herein by reference.

What is claimed is:

1. A printing method comprising:

performing printing on a recording medium, wherein, in the printing, a printing apparatus is used, which includes a head unit in which a plurality of heads discharging inks are disposed side by side in a first direction in two rows, adjacent heads of the plurality of heads being in different rows offset in a second direction transverse to the first direction, and discharges the inks while relatively moving the head unit and the recording medium, and wherein, when the head unit is logically divided into at least three groups of a first group, a second group, and a third group along the two rows of the head unit in the first direction where the plurality of heads are positioned side by side, the first group and the second group share one head, the head being shared is set as a first reference head, the second group and the third group share one head, and the head being shared is set as a second reference head, and wherein, in the printing, a first correction is performed in which a discharging position, where a first correction target head other than the first reference head among the heads of the first group discharges the inks, is corrected based on a position where the first reference head discharges the inks, and a discharging position, where a second correction target head other than the first reference head among the heads of the second group discharges the inks, is corrected based on the position where the first reference head discharges the inks, and a second correction is performed in which a discharging position, where a third correction target head other than the second reference head among the heads of the third group discharges the inks, is corrected based on the discharging position where the first reference head discharges the inks and the discharging position where the second reference head discharges the inks.

2. The printing method according to claim 1, wherein the first correction is correction in which a discharging position is changed by an amount of deviation between a first reference printing pattern being printed by the first reference head and a first correction target pattern printed by the first correction target head, and a discharging position is changed by an amount of deviation between the first reference printing pattern and a second correction target pattern printed by the second correction target head.

3. The printing method according to claim 1, wherein the second correction is correction in which a discharging position is changed by an amount obtained by adding an amount of deviation between a second reference printing pattern being printed by the second reference head and a third correction target pattern being printed by the third correction target head to an amount of deviation between the first reference printing pattern printed by the first reference head and the second reference printing pattern.

4. The printing method according to claim 2, wherein the head includes a plurality of nozzles aligned in one direction, and wherein the first reference printing pattern, the second reference printing pattern, the first correction target pattern, the second correction target pattern, and the third correction target pattern each have a linear shape along the one direction.

5. The printing method according to claim 1, wherein the printing apparatus performs the printing while the head unit reciprocates with respect to the recording medium, and wherein, in the printing, the first correction and the second correction are performed in both of a going passage and a returning passage.

6. The printing method according to claim 1, wherein the printing apparatus includes a plurality of the head units discharging the inks having different colors from each other, and wherein, in the printing, the first correction and the second correction are performed for each head unit.

7. The printing method according to claim 1, wherein the printing is a test printing being performed before printing is performed on the recording medium.

8. A printing apparatus including a head unit in which a plurality of heads discharging inks are disposed side by side, and discharging the inks while moving the head unit, the apparatus comprising:

a controller that performs, when the head unit is logically divided into at least three groups of a first group, a second group, and a third group in a first direction where the plurality of heads are positioned side by side in the first direction in two rows and adjacent heads of the plurality of heads are in different rows offset in a second direction transverse to the first direction, the first group and the second group share one head, the head being shared is set as a first reference head, the second group and the third group share one head, and the head being shared is set as a second reference head, a first correction in which a discharging position, where a first correction target head other than the first reference head among the heads of the first group discharges the inks, is corrected based on a position where the first reference head discharges the inks, and a discharging position, where a second correction target head other than the first reference head among the heads of the second group discharges the inks, is corrected based on the position where the first reference head discharges the inks, and a second correction in which a discharging position, where a third correction target head other than the second reference head among the heads of the third group discharges the inks, is corrected based on the discharging position where the first reference head discharges the inks and the discharging position where the second reference head discharges the inks.

9. A printing pattern being printed by a printing apparatus including a head unit in which a plurality of heads discharging inks are disposed side by side in a first direction in two rows, and discharging the inks toward a recording medium while transporting the recording medium in a direction intersecting the first direction where the heads are positioned side by side, wherein, when the head unit is logically divided into at least two groups of a first group and a second group along the two rows of the head unit, and the first group and the second group share at least one head in the first direction where the plurality of heads are positioned side by side, a first test printing pattern being printed by the first group and a second test printing pattern being printed by the second group are disposed side by side along a direction intersecting a transporting direction of the recording medium.

10. The printing pattern according to claim 9, wherein, when the head unit is logically divided into at least three groups of a first group, a second group, and a third group which share at least one head in a direction where the plurality of heads are positioned side by side, the first test printing pattern, the second test printing pattern, and a third test printing pattern being printed by the third group are disposed side by side along a direction intersecting the transporting direction of the recording medium.

* * * * *